US010001317B2

(12) United States Patent
Takenaka et al.

(10) Patent No.: US 10,001,317 B2
(45) Date of Patent: Jun. 19, 2018

(54) AIR-CONDITIONING APPARATUS PROVIDING DEFROSTING WITHOUT SUSPENDING A HEATING OPERATION

(71) Applicant: Mitsubishi Electric Corporation, Chiyoda-ku (JP)

(72) Inventors: Naofumi Takenaka, Chiyoda-ku (JP); Shinichi Wakamoto, Chiyoda-ku (JP); Koji Yamashita, Chiyoda-ku (JP); Takeshi Hatomura, Chiyoda-ku (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 448 days.

(21) Appl. No.: 14/441,945

(22) PCT Filed: May 21, 2013

(86) PCT No.: PCT/JP2013/064031
§ 371 (c)(1),
(2) Date: May 11, 2015

(87) PCT Pub. No.: WO2014/083867
PCT Pub. Date: Jun. 5, 2014

(65) Prior Publication Data

US 2015/0292789 A1 Oct. 15, 2015

(30) Foreign Application Priority Data

Nov. 29, 2012 (JP) ..... 2012-261016

(51) Int. Cl.
*F25D 21/06* (2006.01)
*F25D 21/00* (2006.01)
(Continued)

(52) U.S. Cl.
CPC ..... *F25D 21/006* (2013.01); *F25B 13/00* (2013.01); *F25B 47/022* (2013.01);
(Continued)

(58) Field of Classification Search
CPC ..... F25D 21/006; F25B 13/00; F25B 47/022; F25B 2313/0233; F25B 2313/0251; F25B 2313/0253
(Continued)

(56) References Cited

U.S. PATENT DOCUMENTS 4,625,524 A 12/1986 Kimura et al.
5,107,684 A * 4/1992 Nakayama ..... F24F 3/065 62/160
(Continued)

FOREIGN PATENT DOCUMENTS

CN 102272534 A 12/2011
CN 202470528 U 10/2012
(Continued)

OTHER PUBLICATIONS

Office Action dated Aug. 11, 2016 in Chinese Patent Application No. 201380062375.4 with English translation.
(Continued)

*Primary Examiner* — Ljiljana Ciric
(74) *Attorney, Agent, or Firm* — Oblon, McClelland, Maier & Neustadt, L.L.P.

(57) ABSTRACT

An air-conditioning apparatus includes a main circuit in which a compressor, an indoor heat exchanger, a first flow control device, and a plurality of parallel heat exchangers connected in parallel to each other are sequentially connected via a pipe to allow refrigerant to circulate, a first defrost pipe that branches a part of the refrigerant discharged from the compressor and allows the refrigerant to flow into the parallel heat exchanger to be defrosted among the plurality of parallel heat exchangers, a expansion device provided in the first defrost pipe and configured to depressurize the refrigerant discharged from the compressor, and a connection switching device that allows the refrigerant
(Continued)

flowing out of the parallel heat exchanger to be defrosted to flow into the main circuit at a position upstream of the parallel heat exchangers other than the parallel heat exchanger subject to defrosting.

13 Claims, 17 Drawing Sheets

(51) Int. Cl.
*F25B 13/00* (2006.01)
*F25B 47/02* (2006.01)

(52) U.S. Cl.
CPC ..... *F25B 2313/0233* (2013.01); *F25B 2313/0251* (2013.01); *F25B 2313/0253* (2013.01); *F25B 2313/02743* (2013.01); *F25B 2400/0411* (2013.01)

(58) Field of Classification Search
USPC ..... 62/151
See application file for complete search history.

(56) References Cited

U.S. PATENT DOCUMENTS

| | | | | |
|---|---|---|---|---|
| 5,878,589 | A * | 3/1999 | Tanaka | B60H 1/00007 165/80.2 |
| 7,089,754 | B2 * | 8/2006 | Chin | F25B 13/00 62/151 |
| 9,279,608 | B2 * | 3/2016 | Wakamoto | F25B 1/10 |
| 9,797,610 | B2 * | 10/2017 | Yamashita | F24F 5/001 |
| 9,822,995 | B2 * | 11/2017 | Wakamoto | F25B 13/00 |
| 9,879,899 | B2 * | 1/2018 | Wightman | F25D 21/04 |
| 9,885,504 | B2 * | 2/2018 | Xu | F25B 30/02 |
| 9,909,785 | B2 * | 3/2018 | Kato | F25B 6/02 |
| 2002/0035843 | A1 * | 3/2002 | Kampf | B60H 1/00328 62/231 |
| 2005/0257557 | A1 * | 11/2005 | Chin | F25B 13/00 62/324.1 |
| 2006/0254308 | A1 | 11/2006 | Yokoyama et al. | |
| 2011/0203299 | A1 * | 8/2011 | Jing | F25B 13/00 62/80 |
| 2011/0232308 | A1 | 9/2011 | Morimoto et al. | |
| 2012/0216989 | A1 * | 8/2012 | Wakamoto | F25B 13/00 165/96 |
| 2013/0098092 | A1 | 4/2013 | Wakamoto et al. | |
| 2014/0182320 | A1 * | 7/2014 | Hatomura | F25B 13/00 62/278 |
| 2015/0198360 | A1 * | 7/2015 | Wakamoto | F25B 13/00 62/324.6 |
| 2015/0292756 | A1 * | 10/2015 | Takenaka | F25B 13/00 62/160 |
| 2015/0292789 | A1 * | 10/2015 | Takenaka | F25B 13/00 62/140 |
| 2016/0116202 | A1 * | 4/2016 | Takenaka | F25B 13/00 62/140 |
| 2016/0273795 | A1 * | 9/2016 | Takenaka | F24F 13/30 |
| 2016/0370045 | A1 * | 12/2016 | Takenaka | F25B 47/02 |
| 2017/0370627 | A1 * | 12/2017 | Takenaka | F25B 47/022 |

FOREIGN PATENT DOCUMENTS

| | | | |
|---|---|---|---|
| EP | 0 184 200 A2 | 6/1986 | |
| EP | 2 378 215 A1 | 10/2011 | |
| JP | 54 85469 | 7/1979 | |
| JP | 62 123264 | 6/1987 | |
| JP | 63 17369 | 1/1988 | |
| JP | 7 280378 | 10/1995 | |
| JP | 2004 219060 | 8/2004 | |
| JP | 2006 23005 | 1/2006 | |
| JP | 2007 32987 | 2/2007 | |
| JP | 2007 271094 | 10/2007 | |
| JP | 2009 85484 | 4/2009 | |
| JP | 2009 281607 | 12/2009 | |
| JP | 2010 164257 | 7/2010 | |
| JP | WO 2012014345 A1 * | 2/2012 | F25B 1/10 |
| WO | 2010 082325 | 7/2010 | |
| WO | 2012 014345 | 2/2012 | |

OTHER PUBLICATIONS

Office Action dated Mar. 29, 2016 in Japanese Patent Application No. 2014-550040 with English translation.
Extended European Search Report dated Jun. 27, 2016 in Patent Application No. 13857995.8.
International Search Report dated Aug. 20, 2013 in PCT/JP13/064031 Filed May 21, 2013.
Chinese Office Action dated Feb. 7, 2017 in Patent Application No. 201380062375.4 (with English Translation).
Huang Xiang, "Air conditioner engineering", China Machine Press, Jan. 2014, p. 251 (with Partial English Translation).
Wang Zhiyuan, "Refrigeration principles and applications", China Machine Press, Jan. 2010, pp. 201-202 (with Partial English Translation).
Combined Chinese Office Action and Search Report dated Feb. 3, 2016 in Patent Application No. 201380062375.4 (with English language translation and English translation of category of cited documents).

* cited by examiner

AIR-CONDITIONING APPARATUS PROVIDING DEFROSTING WITHOUT SUSPENDING A HEATING OPERATION

TECHNICAL FIELD

The present invention relates to an air-conditioning apparatus.

BACKGROUND ART

From the viewpoint of protection of the global environment, many of boiler-based heating apparatuses that burn fossil fuel for heating have recently been substituted with operation heat pump-based air-conditioning apparatuses that utilize air as heat source, even in cold districts.

The heat pump-based air-conditioning apparatus provides heat not only from an electrically driven compressor but also from air, and therefore the heating operation can be performed with added efficiency.

Nevertheless, when outdoor temperature drops frost is formed on an outdoor heat exchanger acting as evaporator, and hence defrosting has to be performed to melt the frost formed on the outdoor heat exchanger.

To defrost the refrigeration cycle may be reversed, however in this case the heating operation for an indoor space is suspended during the defrosting, which degrades comfort in the indoor space.

Accordingly, as one of methods for performing heating operation during the defrosting, there has been proposed a technique of dividing the outdoor heat exchanger so as to utilize a part thereof for the defrosting, while utilizing the other part as evaporator to remove heat from air thereby performing the heating operation (see, for example, Patent Literature 1, Patent Literature 2, and Patent Literature 3).

With the technique according to Patent Literature 1, the outdoor heat exchanger is divided into two heat exchanger sections and, when one of the heat exchangers is to be defrosted, an electronic expansion valve located upstream of the heat exchanger section to be defrosted is closed. Then a solenoid on/off valve of a bypass pipe that conducts refrigerant from the discharge pipe of the compressor to the heat exchanger section is opened, so as to allow a part of high-temperature refrigerant discharged from the compressor to directly flow into the heat exchanger section to be defrosted. When the defrosting of one of the heat exchanger sections is finished, the other heat exchanger section is defrosted.

In this process, in the heat exchanger section being defrosted, the defrosting is performed with the refrigerant pressure set to the same pressure as the suction pressure of the compressor (low-pressure defrosting).

With the technique according to Patent Literature 2, a plurality of heat source units and at least one indoor unit are provided, and setting of a four-way valve is reversed with respect to the direction in a heating operation, only in the heat source unit that includes the heat source-side heat exchanger to be defrosted, so as to allow the refrigerant discharged from the compressor to directly flow into the heat source-side heat exchanger.

In this process, in the heat source-side heat exchanger being defrosted, the defrosting is performed with the refrigerant pressure set to the same pressure as the discharge pressure of the compressor (high-pressure defrosting).

Further, Patent Literature 3 discloses a high-pressure defrosting technique that employs a defrosting apparatus that can also serve as evaporator, installed windward of the outdoor heat exchanger, and an electronic valve that inhibits the refrigerant flowing out of the defrosting apparatus in the defrosting process from reversely flowing to the indoor unit, provided between the defrosting apparatus and the compressor discharge pipe.

In addition, with the technique according to Patent Literature 4, the outdoor heat exchanger is divided into a plurality of parallel heat exchangers, and a part of the high-temperature refrigerant discharged from the compressor is alternately introduced into each of the parallel heat exchangers to thereby alternately defrost the parallel heat exchangers. This technique enables the heating operation to be continuously performed without reversing the refrigeration cycle. The refrigerant supplied to the parallel heat exchanger subject to defrosting is injected from an injection port of the compressor.

In this process, in the parallel heat exchanger being defrosted, the defrosting is performed with the refrigerant pressure set to a pressure lower than the discharge pressure of the compressor and higher than the suction pressure thereof, more specifically a pressure corresponding to a saturation temperature slightly higher than 0 degrees Celsius converted from the pressure (medium-pressure defrosting).

CITATION LIST

Patent Literature

Patent Literature 1: Japanese Unexamined Patent Application Publication No. 2009-085484 (paragraph [0019], FIG. 3)

Patent Literature 2: Japanese Unexamined Patent Application Publication No. 2007-271094 (paragraph [0007], FIG. 2)

Patent Literature 3: Japanese Unexamined Patent Application Publication No. 2004-219060 (paragraphs [0032], [0046], and [0082] to [0084], FIG. 1)

Patent Literature 4: International Publication No. 2012/014345 (paragraph [0006], FIG. 1)

SUMMARY OF INVENTION

Technical Problem

With the low-pressure defrosting according to Patent Literature 1, the heat exchanger section to be defrosted and the heat exchanger section acting as evaporator (i.e., heat exchanger section not being subjected to defrosting) operate in the same pressure zone. The heat exchanger section acting as evaporator removes heat from outdoor air, and hence the evaporation temperature of the refrigerant has to be set lower than the outdoor temperature.

Accordingly, the temperature of the refrigerant becomes lower than the outdoor air also in the heat exchanger section being defrosted, and the saturation temperature may drop below 0 degrees Celsius. In such a case the condensation latent heat of the refrigerant is unable to be utilized for melting the frost, the temperature of which is 0 degrees Celsius, and the defrosting efficiency is degraded.

In the case of the high-pressure defrosting according to Patent Literature 2 and Patent Literature 3, the degree of subcooling of the refrigerant flowing out of the heat source-side heat exchanger after being used for the defrosting is increased.

Accordingly, temperature distribution is generated inside the heat source-side heat exchanger being defrosted, which degrades the defrosting efficiency. In addition, the increase in degree of subcooling leads to a proportional increase in amount of the liquid refrigerant in the heat source-side heat exchanger to be defrosted, and therefore the flow of the liquid refrigerant is decelerated.

With the medium-pressure defrosting according to Patent Literature 4, the saturation temperature of the refrigerant is set to slightly higher than 0 degrees Celsius (approximately 0 degrees Celsius to 10 degrees Celsius), to enable the utilization of the condensation latent heat. The medium-pressure defrosting sets the entirety of the parallel heat exchangers to a generally uniform temperature thereby achieving higher defrosting efficiency, compared with the low-pressure defrosting and the high-pressure defrosting. However, the liquid amount of the refrigerant that can be injected from the injection port of the compressor has a certain limit, and therefore the flow rate of the refrigerant that can be supplied to the parallel heat exchanger subject to defrosting is limited.

Consequently, the defrosting capacity is limited and therefore the defrosting time is unable to be shortened. In addition, the compressor has to be provided with the injecting function, which leads to an increase in manufacturing cost.

The present invention has been accomplished in view of the foregoing situation, and provides an air-conditioning apparatus capable of performing the defrosting operation with high efficiency, without suspending the heating operation of the indoor unit.

Solution to Problem

In an aspect, the present invention provides an air-conditioning apparatus comprising: a main circuit formed by sequentially connecting, via a pipe, a compressor, an indoor heat exchanger, a first flow control device, and a plurality of parallel heat exchangers so as to allow refrigerant to circulate; a first defrost pipe configured to branch from a flow path of the refrigerant from the compressor, allow a part of the refrigerant discharged from the compressor to path therethrough, allow any of the plurality of parallel heat exchangers to be selected as a parallel heat exchanger subject to defrosting, and allow the part of the refrigerant to flow into the parallel heat exchanger selected as the parallel heat exchanger subject to defrosting; a first expansion device provided in the first defrost pipe and configured to depressurize the refrigerant discharged from the compressor; and a connection switching device that allows the refrigerant flowing out of the parallel heat exchanger subject to defrosting to flow into the main circuit at a position upstream of one or more of the parallel heat exchangers other than the parallel heat exchanger subject to defrosting.

Advantageous Effects of Invention

With the air-conditioning apparatus configured as above, defrosting can be performed with high efficiency, without suspending heating operation of the indoor unit.

DESCRIPTION OF EMBODIMENTS

Hereafter, Embodiments of the present invention will be described with reference to the drawings.

The constituents given the same numeral in different drawings are the same or corresponding ones, which applies throughout the present description.

Further, throughout the description, the configuration of the constituents is merely exemplary and in no way intended to limit the feature of the present invention.

Embodiment 1

Figure 1:
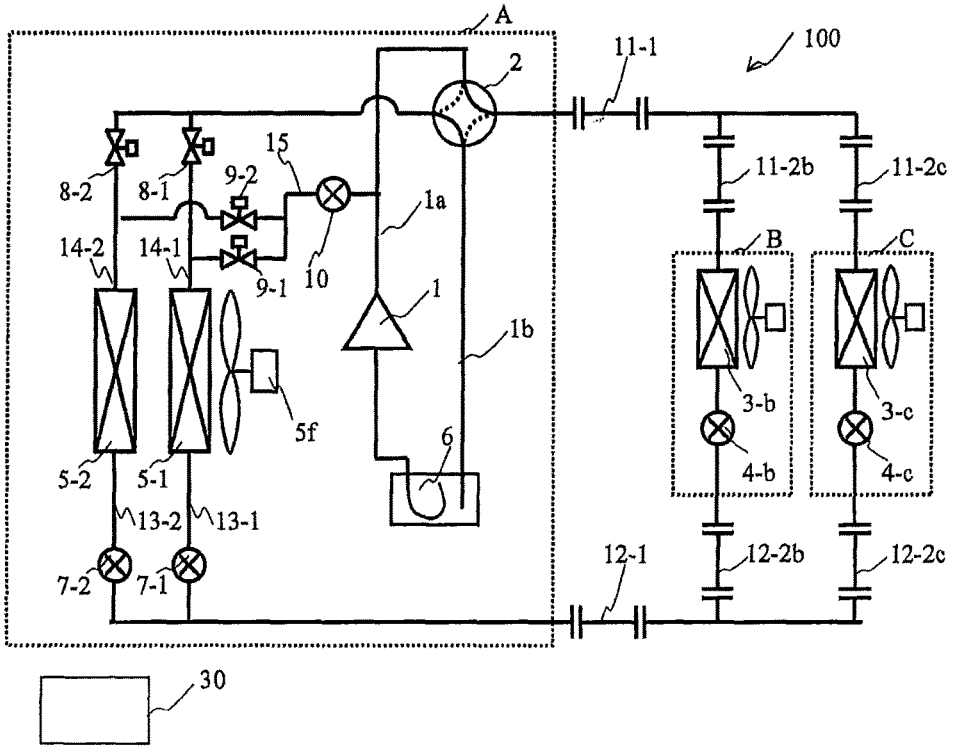
FIG. 1 is a circuit diagram showing a refrigerant circuit configuration of an air-conditioning apparatus 100 according to Embodiment 1 of the present invention.

FIG. 1 is a circuit diagram showing a refrigerant circuit configuration of an air-conditioning apparatus 100 according to Embodiment 1 of the present invention.

The air-conditioning apparatus 100 includes an outdoor unit A and a plurality of indoor units B and C connected in parallel to each other, and the outdoor unit A and the indoor units B and C are connected to each other via first extension pipes 11-1, 11-2*b*, and 11-2*c* and second extension pipes 12-1, 12-2*b*, and 12-2*c*.

The air-conditioning apparatus 100 also includes a controller 30, which controls the cooling operation and heating operation (normal heating operation and heating-defrosting operation) of the indoor units B and C.

The refrigerant employed herein may be a Freon refrigerant or a HFO refrigerant. Examples of the Freon refrigerant include R32, R125, and R134a which are HFC-based refrigerants, and R410A, R407c, and R404A which are mixed refrigerants. Examples of the HFO refrigerant include HFO-1234yf, HFO-1234ze(E), and HFO-1234ze(Z). In addition, a refrigerant applicable to a vapor compression heat pump may be employed, such as a $CO_2$ refrigerant, a HC refrigerant such as propane or isobutene refrigerant, ammonia refrigerant, and a mixture of the above cited refrigerants, for example a mixture of R32 and HFO-1234yf.

Although Embodiment 1 refers to the case where two indoor units B and C are connected to the single outdoor unit A, the indoor unit may be just one, and two or more outdoor units may be connected in parallel. Alternatively, the refrigerant circuit may be configured so as to allow each of the indoor units to select a cooling or heating operation, for example by connecting three extension pipes in parallel or providing a switching valve on the side of the indoor unit.

The configuration of the refrigerant circuit in the air-conditioning apparatus 100 will be described hereunder.

The refrigerant circuit of the air-conditioning apparatus 100 includes a main circuit, in which a compressor 1, a cooling-heating switching device 2 that switches between the cooling operation and the heating operation, indoor heat exchangers 3-*b*, 3-*c*, first flow control devices 4-*b*, 4-*c* that can be opened and closed, and an outdoor heat exchanger 5 are sequentially connected via a pipe.

The main circuit also includes an accumulator 6 which, however, may be omitted.

The cooling-heating switching device 2 is connected between a discharge pipe 1*a* and a suction pipe 1*b* of the compressor 1, and constituted of, for example, a four-way valve that switches the flow direction of the refrigerant.

In the heating operation the cooling-heating switching device 2 connects the refrigerant flow as indicated by solid lines in FIG. 1, and in the cooling operation the cooling-heating switching device 2 connects the refrigerant flow as indicated by dotted lines in FIG. 1.

Figure 2A:
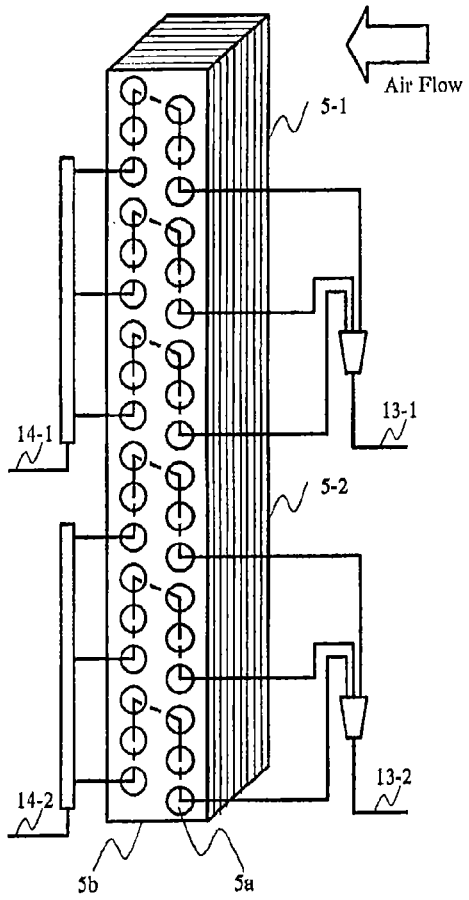
FIG. 2A is a schematic perspective view showing a configuration of an outdoor heat exchanger of the air-conditioning apparatus 100 according to Embodiment 1 of the present invention.

FIG. 2A is a schematic perspective view showing a configuration of the outdoor heat exchanger of the air-conditioning apparatus 100 according to Embodiment 1 of the present invention.

As shown in FIG. 2A, the outdoor heat exchanger 5 is constituted of, for example, a fin tube-type heat exchanger including a plurality of heat transfer tubes 5*a* and a plurality of fins 5*b*. The outdoor heat exchanger 5 is divided into a plurality of parallel heat exchangers. It will herein be assumed that the outdoor heat exchanger 5 is divided into two parallel heat exchangers 5-1 and 5-2.

The heat transfer tubes 5*a*, through which the refrigerant flows, are aligned in a plurality of rows in a column direction perpendicular to an air passage direction and in a row direction parallel to the air passage direction.

Fins 5*b* are aligned with a spacing therebetween, so as to allow air to flow in the air passage direction.

The parallel heat exchangers 5-1 and 5-2 are formed by dividing the outdoor heat exchanger 5 inside the casing of the outdoor unit A. The parallel heat exchangers may be divided in a left-right direction, however in this case the inlet for the refrigerant into each of the parallel heat exchangers 5-1 and 5-2 is located on the left and right end portion of the outdoor unit A, which makes the pipe connection complicated. Therefore, it is preferable to divide the outdoor heat exchanger 5 in an up-down direction as shown in FIG. 2A.

The fins 5*b* attached to the parallel heat exchangers 5-1 and 5-2 may be unified as shown in FIG. 2A, or separated for each of the parallel heat exchangers 5-1 and 5-2. In addition, outdoor heat exchanger 5 may be divided into a desired number of parallel heat exchangers, without limitation to two.

Outdoor air introduced into the parallel heat exchangers 5-1 and 5-2 is transported by an outdoor fan 5*f*.

Although a single outdoor fan 5*f* is provided in FIG. 1, the parallel heat exchangers 5-1 and 5-2 may each be provided with the outdoor fan.

First connection pipes 13-1 and 13-2 are connected to the parallel heat exchangers 5-1 and 5-2 on the side thereof connected to the first flow control device 4-*b*, 4-*c*, respectively.

The first connection pipes 13-1 and 13-2 respectively include second flow control devices 7-1 and 7-2, and are connected in parallel to a main pipe extending from the second flow control devices 7-1 and 7-2.

The second flow control devices 7-1 and 7-2 are valves the opening degree of which is variable according to an instruction from the controller 30. The second flow control devices 7-1 and 7-2 are constituted of, for example, an electronically controlled expansion valve.

The second flow control devices 7-1 and 7-2 according to Embodiment 1 correspond to the connection switching device and the second expansion device in the present invention.

Second connection pipes 14-1 and 14-2 are respectively connected to the parallel heat exchangers 5-1 and 5-2 on the side thereof connected to the compressor 1, and connected to the compressor 1 via first solenoid valves 8-1 and 8-2, respectively.

The refrigerant circuit further includes a first defrost pipe 15 for supplying a part of the high-temperature/high-pressure refrigerant discharged from the compressor 1 to the parallel heat exchanges 5-1 and 5-2 for the purpose of defrosting.

The first defrost pipe 15 has an end connected to the discharge pipe 1*a* and the other end branched into two lines which are respectively connected to the second connection pipes 14-1 and 14-2.

The first defrost pipe 15 includes a expansion device 10, which serves to depressurize a part of the high-temperature/high-pressure refrigerant discharged from the compressor 1 to a medium pressure, before the refrigerant is supplied to the parallel heat exchangers 5-1 and 5-2. The lines branched from the first defrost pipe 15 respectively include second solenoid valves 9-1 and 9-2.

Figure 2B:
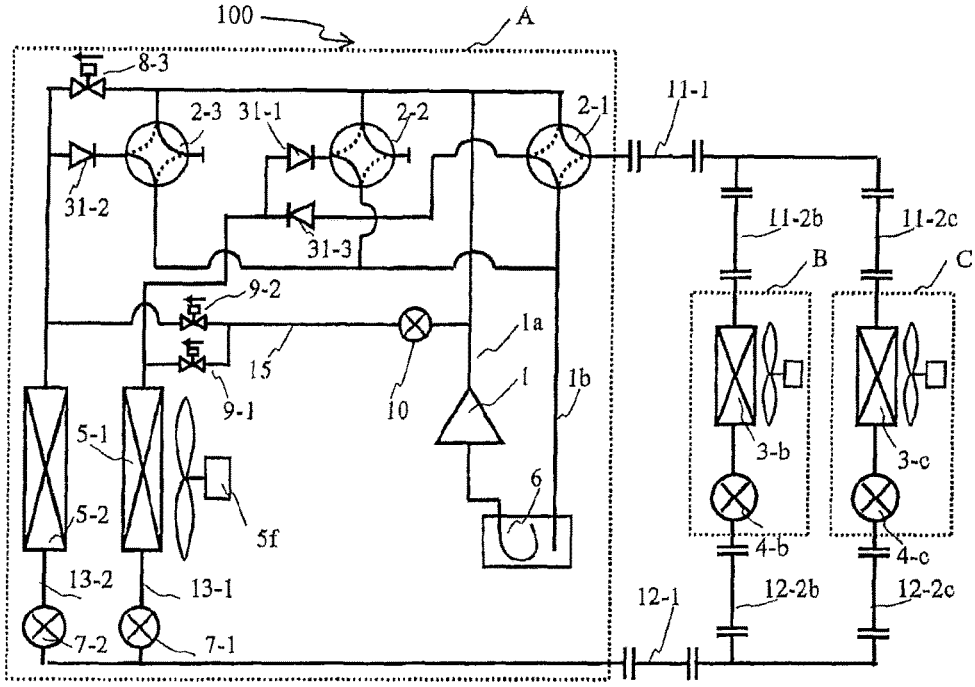
FIG. 2B is a circuit diagram showing another refrigerant circuit configuration of the air-conditioning apparatus 100 according to Embodiment 1 of the present invention.

Here, it suffices that the first solenoid valves 8-1 and 8-2 and the second solenoid valves 9-1 and 9-2 are capable of switching the flow path, and hence may be a four-way valve, a three-way valve, or a two-way valve instead. In addition, the pressure at the inlet and the outlet of the solenoid valves 8-1 and 8-2 is reversed in the cooling operation, the heating operation, and the defrosting operation. Ordinary solenoid valves may be unusable when the pressure is reversed between the inlet side and the outlet side. In this case, as shown in FIG. 2B, it is preferable to employ four-way valves 2-1, 2-2, and 2-3 connected via the high-pressure side to the discharge pipe 1*a* of the compressor 1 and via the low-pressure side to the suction pipe 1*b* of the compressor 1, a solenoid valve 8-3 that only allows a unidirectional flow, and check valves 31-1, 31-2, and 31-3, so as to achieve the same function as that of the solenoid valves 8-1 and 8-2 that allows bidirectional flow of the refrigerant. Here, the side of the discharge pipe 1*a* of the compressor 1 is constantly the high-pressure side, and hence the solenoid valves 9-1 and 9-2 may be unidirectional valves.

In the case where the necessary defrosting capacity, in other words the flow rate of the refrigerant required for the defrosting is determined, the expansion device 10 may be constituted of capillary tubes. Alternatively, the expansion device 10 may be omitted and smaller-sized solenoid valves 9-1 and 9-2 may be employed so as to reduce the pressure to a medium pressure under the predetermined flow rate for the defrosting. Further, the expansion device 10 may be omitted and the second solenoid valves 9-1 and 9-2 may be substituted with a flow control device.

The expansion device 10 corresponds to the first expansion device in the present invention.

The operations performed by the air-conditioning apparatus 100 will now be described hereunder.

The air-conditioning apparatus 100 is configured to perform two operation modes, namely the cooling operation and the heating operation.

Further, the heating operation includes a normal heating operation in which the parallel heat exchangers 5-1 and 5-2 constituting the outdoor heat exchanger 5 both act as evaporator, and a heating-defrosting operation (also called continuous heating operation).

In the heating-defrosting operation, the parallel heat exchanger 5-1 and the parallel heat exchanger 5-2 are alternately defrosted while the heating operation is continued. To be more detailed, one of the parallel heat exchangers is defrosted while the other parallel heat exchanger acts as evaporator so as to continue the heating operation. When the defrosting of the former parallel heat exchanger is finished, this former parallel heat exchanger is in turn set to act as evaporator, and the latter parallel heat exchanger is defrosted.

Table 1 given below collectively specifies the on/off setting and the opening degree control of the valves in the air-conditioning apparatus 100 shown in FIG. 1.

"ON" of the cooling-heating switching device 2 in Table 1 corresponds to the state where the four-way valve shown in FIG. 1 is set for the flow indicted by the solid lines, and "OFF" corresponds to the state where the four-way valve is set for the flow indicted by the dotted lines. "ON" of the solenoid valves 8-1, 8-2 and 9-1, 9-2 corresponds to the state where the solenoid valve is opened to allow the refrigerant to flow, and "OFF" corresponds to the state where the solenoid valve is closed.

TABLE 1

| | | HEATING | | |
|---|---|---|---|---|
| | | NORMAL | CONTINUOUS HEATING | |
| VALVE NO. | COOLING | HEATING OPERATION | 5-1: EVAPORATOR 5-2: DEFROST | 5-1: DEFROST 5-2: EVAPORATOR |
| 2 | OFF | ON | ON | ON |
| 4-b, 4-c | INDOOR UNIT OUTLET SUPERHEAT | INDOOR UNIT OUTLET SUBCOOL | INDOOR UNIT OUTLET SUBCOOL | INDOOR UNIT OUTLET SUBCOOL |
| 7-1 | FULL OPEN | FULL OPEN | FULL OPEN | PRESSURE OF DEFROSTED HEAT EXCHANGER |
| 7-2 | FULL OPEN | FULL OPEN | PRESSURE OF DEFROSTED HEAT EXCHANGER | FULL OPEN |
| 8-1 | ON | ON | ON | OFF |
| 8-2 | ON | ON | OFF | ON |
| 9-1 | OFF | OFF | OFF | ON |
| 9-2 | OFF | OFF | ON | OFF |
| 10 | CLOSED | CLOSED | FIXED OPENING DEGREE | FIXED OPENING DEGREE |

[Cooling Operation]

Figure 3:
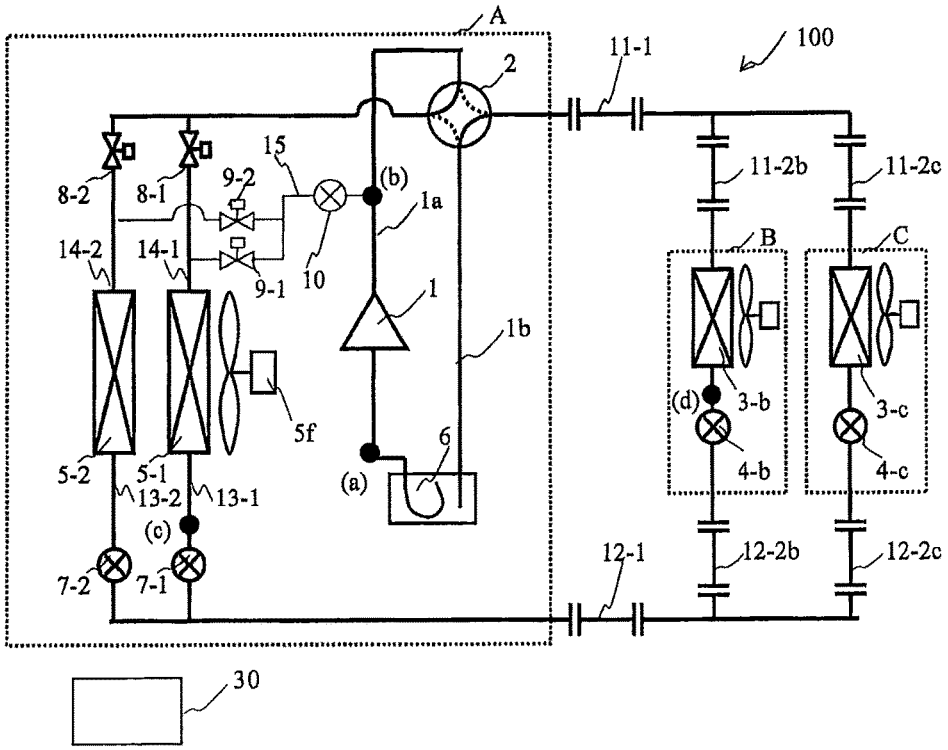
FIG. 3 is a circuit diagram showing a refrigerant flow in a cooling operation of the air-conditioning apparatus 100 according to Embodiment 1 of the present invention.

FIG. 3 is a circuit diagram showing a refrigerant flow in the cooling operation of the air-conditioning apparatus 100 according to Embodiment 1 of the present invention. In FIG.

3, bold lines indicate the refrigerant flow in the cooling operation, and fine lines indicate the sections where the refrigerant does not flow.

Figure 4:
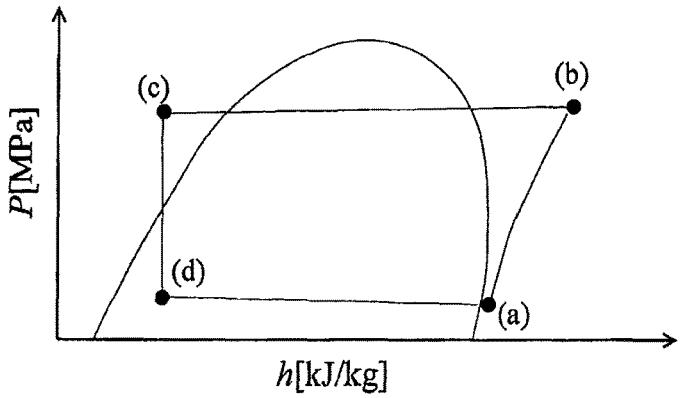
FIG. 4 is a P-h line graph of the cooling operation of the air-conditioning apparatus 100 according to Embodiment 1 of the present invention.

FIG. 4 is a P-h line graph of the cooling operation of the air-conditioning apparatus 100 according to Embodiment 1 of the present invention. Points (a) to (d) in FIG. 4 indicate the status of the refrigerant at the positions of the same reference code in FIG. 3.

When the compressor 1 is activated, low-temperature/low-pressure gas refrigerant is compressed by the compressor 1 and discharged therefrom in the state of high-temperature/high-pressure gas refrigerant.

In the refrigerant compression process of the compressor 1, the refrigerant is compressed by an extent corresponding to the heat insulation efficiency of the compressor 1, with respect to the insulated compression along an isentropic line, as indicated by a line drawn between the point (a) and the point (b) in FIG. 4.

The high-temperature/high-pressure gas refrigerant discharged from the compressor 1 passes through the cooling-heating switching device 2 and is then divided into two flows, one of which passes through the solenoid valve 8-1 and flows into the parallel heat exchanger 5-1 through the second connection pipe 14-1. The other branched flow passes through the solenoid valve 8-2 and flows into the parallel heat exchanger 5-2 through the second connection pipe 14-2.

The refrigerant which has entered the parallel heat exchangers 5-1 and 5-2 is cooled by heating the outdoor air, thereby turning into medium-temperature/high-pressure liquid refrigerant. The transition of the refrigerant in the parallel heat exchangers 5-1 and 5-2 may be expressed by a slightly inclined, generally horizontal line drawn between the point (b) and the point (c) in FIG. 4, when pressure loss in the outdoor heat exchanger 5 is taken into account.

Here, for example in the case where the indoor units B and C do only require a small operation capacity, the solenoid valve 8-2 may be closed to keep the refrigerant from flowing into the parallel heat exchanger 5-2 to resultantly reduce the heat transfer area in the outdoor heat exchanger 5. Such an arrangement stabilizes the operation of the refrigeration cycle.

The medium-temperature/high-pressure liquid refrigerant which has flowed out of the parallel heat exchangers 5-1 and 5-2 flows into the first connection pipes 13-1 and 13-2, and joins after passing through the second flow control devices 7-1 and 7-2 which are fully opened. The refrigerant which has joined passes through the second extension pipes 12-1, 12-2*b*, 12-2*c* and enters the first flow control devices 4-*b* and 4-*c* to be expanded and depressurized therein, thus to turn into low-temperature/low-pressure gas-liquid two-phase refrigerant. Such transition of the refrigerant in the first flow control devices 4-*b* and 4-*c* takes place under a constant enthalpy. The mentioned transition of the refrigerant can be expressed by the vertical line drawn between the point (c) and the point (d) in FIG. 4.

The low-temperature/low-pressure gas-liquid two-phase refrigerant which has flowed out of the first flow control device 4-*b* and 4-*c* flows into the indoor heat exchangers 3-*b* and 3-*c*. The refrigerant which has entered the indoor heat exchangers 3-*b* and 3-*c* is heated by cooling the indoor air, thereby turning into low-temperature/low-pressure gas refrigerant. Here, the first flow control devices 4-*b* and 4-*c* are controlled so as to set the degree of superheating of the low-temperature/low-pressure gas refrigerant to approximately 2 K to 5 K.

The transition of the refrigerant in the indoor heat exchangers 3-*b* and 3-*c* may be expressed by a slightly inclined, generally horizontal line drawn between the point (e) and the point (a) in FIG. 4, when pressure loss is taken into account. The low-temperature/low-pressure gas refrigerant which has flowed out of the indoor heat exchangers 3-*b* and 3-*c* passes through the first extension pipes 11-2*b*, 11-2*c*, and 11-1, the cooling-heating switching device 2, and the accumulator 6, and flows into the compressor 1 to be compressed therein.

[Normal Heating Operation]

Figure 5:
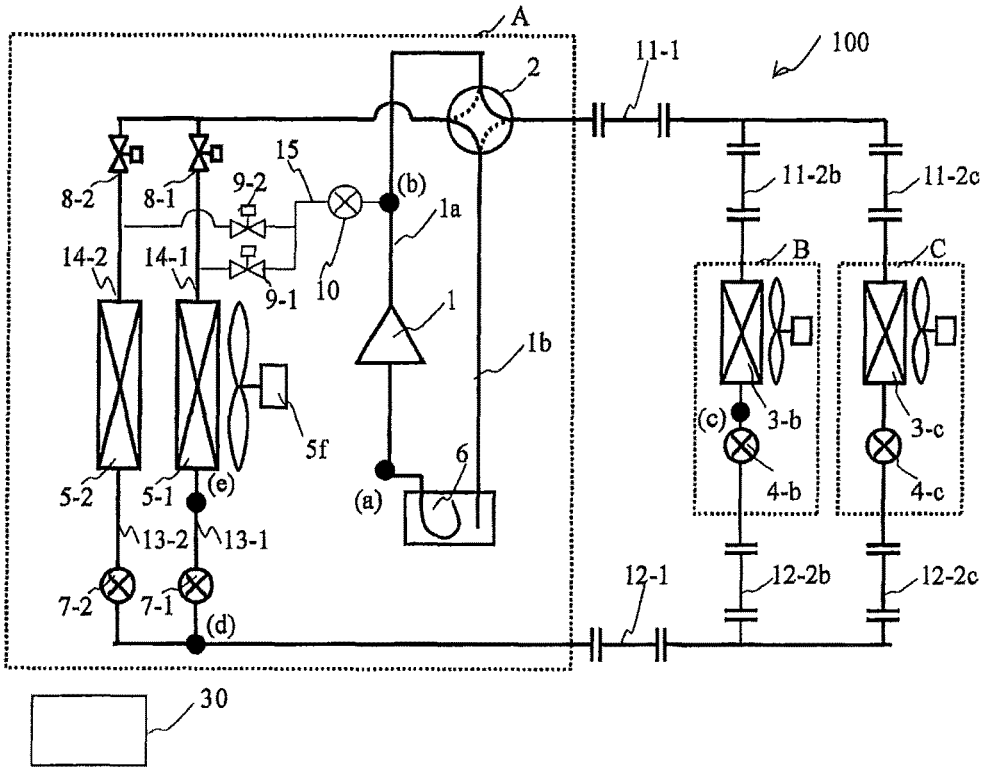
FIG. 5 is a circuit diagram showing a refrigerant flow in a normal heating operation of the air-conditioning apparatus 100 according to Embodiment 1 of the present invention.

FIG. 5 is a circuit diagram showing the refrigerant flow in the normal heating operation of the air-conditioning apparatus 100 according to Embodiment 1 of the present invention. In FIG. 5, bold lines indicate the refrigerant flow in the normal heating operation, and fine lines indicate the sections where the refrigerant does not flow.

Figure 6:
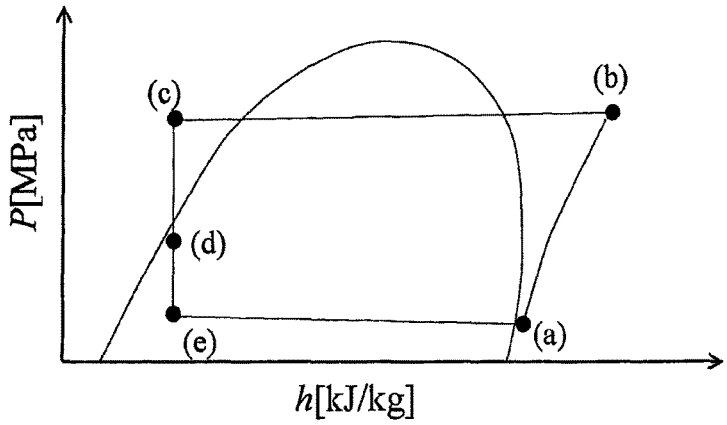
FIG. 6 is a P-h line graph of the normal heating operation of the air-conditioning apparatus 100 according to Embodiment 1 of the present invention.

FIG. 6 is a P-h line graph of the normal heating operation of the air-conditioning apparatus 100 according to Embodiment 1 of the present invention. Points (a) to (e) in FIG. 6 indicate the status of the refrigerant at the positions of the same reference code in FIG. 5.

Upon activating the compressor 1, the low-temperature/low-pressure gas refrigerant is compressed by the compressor 1 and discharged therefrom in the state of high-temperature/high-pressure gas refrigerant. The refrigerant compression process in the compressor 1 can be expressed as a line drawn between the point (a) to the point (b) in FIG. 6.

The high-temperature/high-pressure gas refrigerant discharged from the compressor 1 passes through the cooling-heating switching device 2 and flows out of the outdoor unit A. The high-temperature/high-pressure gas refrigerant which has flowed out of the outdoor unit A flows into the indoor heat exchangers 3-*b* and 3-*c* of the indoor units B and C, through the first extension pipes 11-1, 11-2*b*, and 11-2*c*.

The refrigerant which has entered the indoor heat exchangers 3-*b* and 3-*c* is cooled by heating the indoor air, thereby turning into medium-temperature/high-pressure liquid refrigerant. The transition of the refrigerant in the indoor heat exchangers 3-*b* and 3-*c* may be expressed by a slightly inclined, generally horizontal line drawn between the point (b) and the point (c) in FIG. 6.

The medium-temperature/high-pressure liquid refrigerant which has flowed out of the indoor heat exchangers 3-*b* and 3-*c* flows into the first flow control devices 4-*b* and 4-*c* to be expanded and depressurized therein, thus to turn into medium pressure gas-liquid two-phase refrigerant.

The transition of the refrigerant in the mentioned process may be expressed by a vertical line drawn between the point (c) and the point (d) in FIG. 6.

Here, the first flow control devices 4-*b* and 4-*c* are controlled so as to set the degree of subcooling of the medium-temperature/high-pressure liquid refrigerant to approximately 5 K to 20 K.

The medium pressure gas-liquid two-phase refrigerant which has flowed out of the first flow control devices 4-*b* and 4-*c* returns to the outdoor unit A through the second extension pipes 12-2*b*, 12-2*c*, and 12-1. The refrigerant which has returned to the outdoor unit A flows into the first connection pipes 13-1 and 13-2.

The refrigerant which has entered the first connection pipes 13-1 and 13-2 is expanded and depressurized in the second flow control devices 7-1 and 7-2 to turn into low-pressure gas-liquid two-phase refrigerant. The transition of the refrigerant in this process may be expressed by a line drawn between the point (d) and the point (e) in FIG. 6.

Here, the second flow control devices 7-1 and 7-2 are either fixed at a constant opening degree, for example fully opened, or controlled so as to bring the intermediate pressure of the second extension pipe 12-1 to a level corresponding to a saturation temperature of approximately 0 degrees Celsius to 20 degrees Celsius converted from the pressure.

The refrigerant which has flowed out of the second flow control devices 7-1 and 7-2 flows into the parallel heat exchangers 5-1 and 5-2 and is heated by cooling the outdoor air, thereby turning into low-temperature/low-pressure gas refrigerant. The transition of the refrigerant in the parallel heat exchangers 5-1 and 5-2 may be expressed by a slightly inclined, generally horizontal line drawn between the point (e) and the point (a) in FIG. 6.

The low-temperature/low-pressure gas refrigerant which has flowed out of the parallel heat exchangers 5-1 and 5-2 flows into the second connection pipes 14-1 and 14-2, and joins after passing through the solenoid valves 8-1 and 8-2, and then flows into the compressor 1 through the cooling-heating switching device 2 and the accumulator 6, to be compressed in the compressor 1.

[Heating-Defrosting Operation (Continuous Heating Operation)]

The heating-defrosting operation is performed when frost is formed on the outdoor heat exchanger 5 while performing the normal heating operation.

It is determined that frost has been formed, for example when the saturation temperature converted from the suction pressure of the compressor 1 significantly drops below a predetermined outdoor temperature. Alternatively, for example, it may be determined that frost has been formed when the difference between the outdoor temperature and the evaporation temperature exceeds a predetermined value and such difference is maintained for a predetermined period of time.

In the air-conditioning apparatus 100 configured as Embodiment 1, in the heating-defrosting operation the parallel heat exchanger 5-2 may be subjected to the defrosting while the parallel heat exchanger 5-1 is acting as evaporator to continue the heating operation. Conversely, the parallel heat exchanger 5-2 may act as evaporator to continue the heating operation, while the parallel heat exchanger 5-1 is subjected to the defrosting.

Such operations are performed in the same way, only except that the open/close status of the solenoid valves 8-1, 8-2 and 9-1, 9-2 is reversed, and the refrigerant flows through either of the parallel heat exchanger 5-1 and the parallel heat exchanger 5-2. The following description will be made, therefore, on the assumption that the parallel heat exchanger 5-2 is subjected to the defrosting while the parallel heat exchanger 5-1 is acting as evaporator to continue the heating operation. This also applies to the description of subsequent Embodiments.

Figure 7:
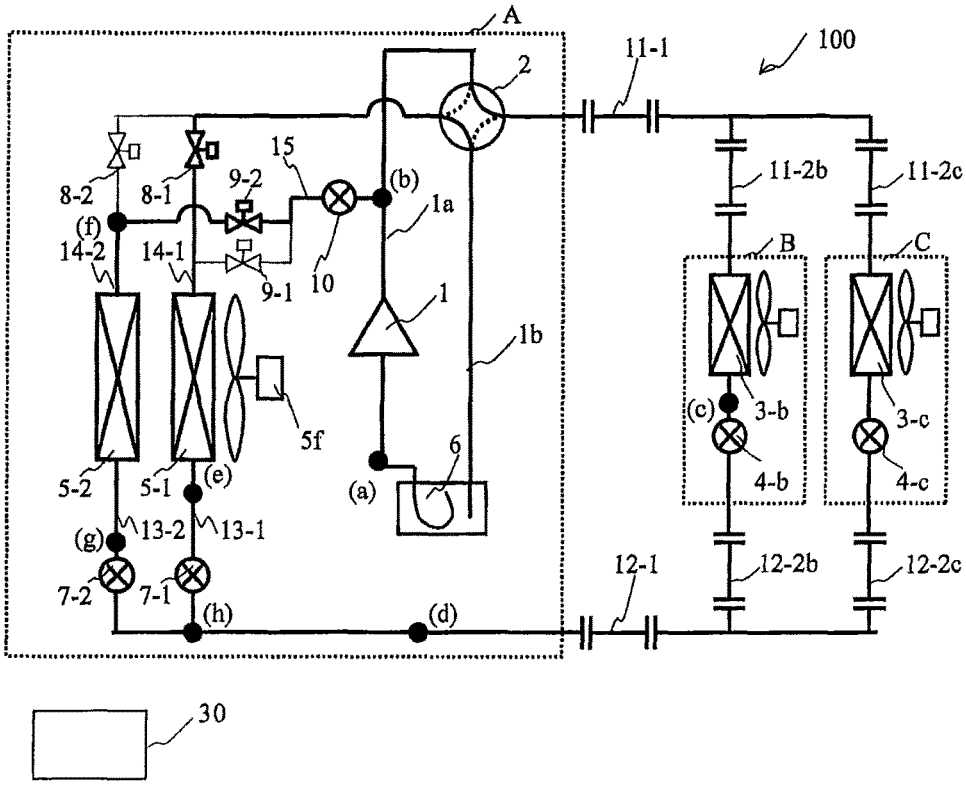
FIG. 7 is a circuit diagram showing a refrigerant flow in a heating-defrosting operation of the air-conditioning apparatus 100 according to Embodiment 1 of the present invention.

FIG. 7 is a circuit diagram showing the refrigerant flow in the heating-defrosting operation of the air-conditioning apparatus 100 according to Embodiment 1 of the present invention. In FIG. 7, bold lines indicate the refrigerant flow in the heating-defrosting operation, and fine lines indicate the sections where the refrigerant does not flow.

Figure 8A:
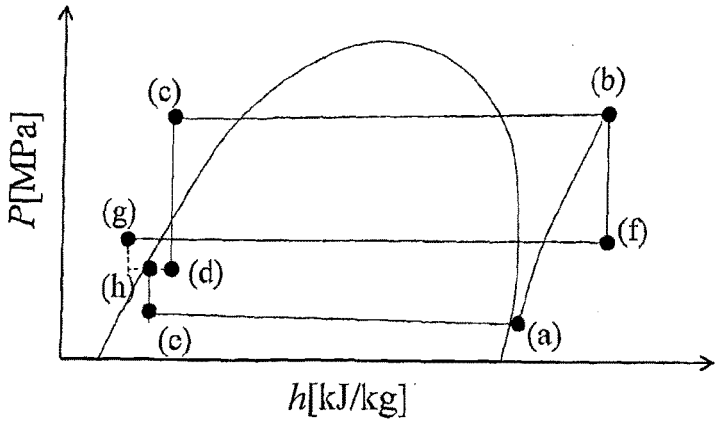
FIG. 8A is a P-h line graph of the heating-defrosting operation of the air-conditioning apparatus 100 according to Embodiment 1 of the present invention.

FIG. 8A is a P-h line graph of the heating-defrosting operation of the air-conditioning apparatus 100 according to Embodiment 1 of the present invention. Points (a) to (h) in FIG. 8 indicate the status of the refrigerant at the positions of the same reference code in FIG. 7.

The controller 30 closes the solenoid valve 8-2 associated with the parallel heat exchanger 5-2 to be defrosted, upon detecting that the defrosting has to be performed to remove the frost while performing the normal heating operation. The controller 30 then opens the second solenoid valve 9-2 and sets the opening of the expansion device 10 to a predetermined degree.

With such settings, the medium-pressure defrosting circuit, in which the compressor 1, the expansion device 10, the solenoid valve 9-2, the parallel heat exchanger 5-2, the second flow control device 7-2, and the second flow control device 7-1 are sequentially connected, is opened and the heating-defrosting operation can be started.

When the heating-defrosting operation is started, a part of the high-temperature/high-pressure gas refrigerant discharged from the compressor 1 flows into the first defrost pipe 15 and is depressurized to the medium pressure in the expansion device 10. The transition of the refrigerant in this process may be expressed by the line drawn between the point (b) and the point (f) in FIG. 8A.

The refrigerant depressurized to the medium pressure (point (f)) passes through the solenoid valve 9-2 and flows into the parallel heat exchanger 5-2. The refrigerant which has entered the parallel heat exchanger 5-2 exchanges heat with the frost stuck to the parallel heat exchanger 5-2, thereby being cooled.

As described above, the frost stuck to the parallel heat exchanger 5-2 can be melted by introducing the high-temperature/high-pressure gas refrigerant discharged from the compressor 1 into the parallel heat exchanger 5-2. The transition of the refrigerant in this process may be expressed by a line drawn between the point (f) and the point (g) in FIG. 8A.

Here, the refrigerant used for the defrosting has the saturation temperature of approximately 0 degrees Celsius to 10 degrees Celsius, which is higher than the temperature of the frost (0 degrees Celsius).

The refrigerant joins the main circuit through the second flow control device 7-2, after being used for the defrosting (point (h)). The refrigerant which has joined the main circuit flows into the parallel heat exchanger 5-1 acting as evaporator, thus to be evaporated.

A reason that the saturation temperature of the refrigerant used for the defrosting is set to equal to or higher than 0 degrees Celsius and equal to or lower than 10 degrees Celsius will be described hereunder, with reference to FIG. 8B to FIG. 8F.

Figure 8B:
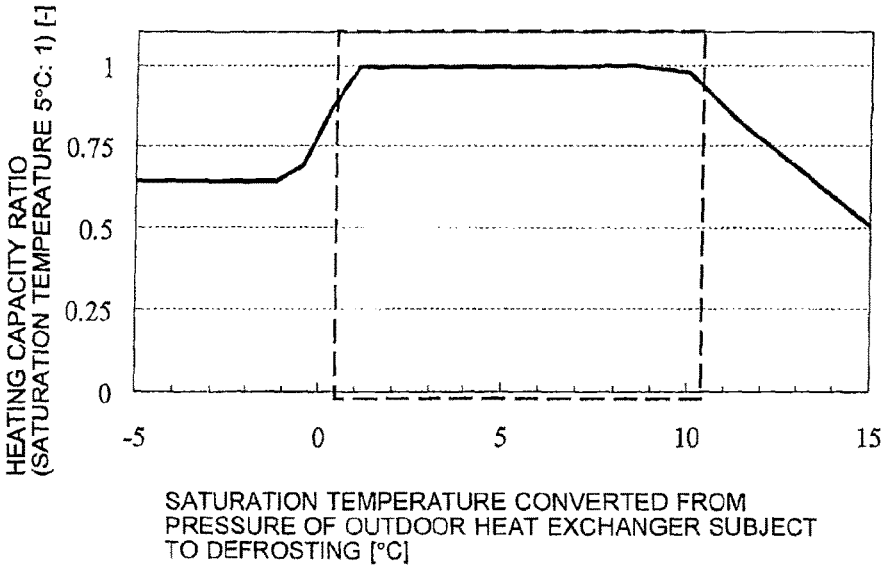
FIG. 8B is a graph showing ratios of heating operation capacity under different pressures (converted to saturated liquid temperature) of the outdoor heat exchanger to be defrosted, of the air-conditioning apparatus 100 according to Embodiment 1 of the present invention.

FIG. 8B is a graph showing the heating operation capacity based on fixed defrosting capacity, under different pressures (converted to saturated liquid temperature) of the outdoor heat exchanger 5 to be defrosted, in the air-conditioning apparatus that employs the R410A refrigerant.

Figure 8C:
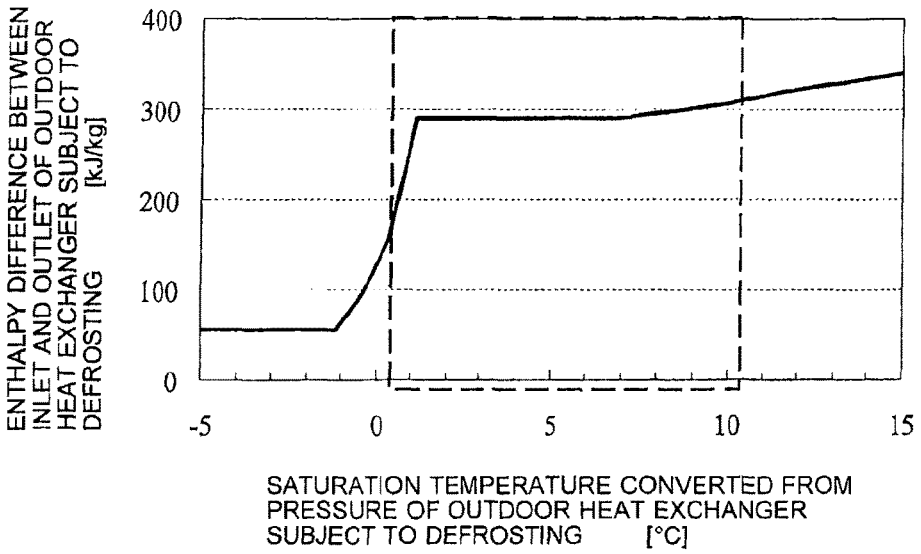
FIG. 8C is a graph showing differences in enthalpy between the inlet and the outlet of the outdoor heat exchanger to be defrosted, under different pressures (converted to saturated liquid temperature) of the outdoor heat exchanger to be defrosted, of the air-conditioning apparatus 100 according to Embodiment 1 of the present invention.

FIG. 8C is a graph showing differences in enthalpy between the inlet and the outlet of the outdoor heat exchanger 5 to be defrosted based on fixed defrosting capacity, under different pressures (converted to saturated liquid temperature) of the outdoor heat exchanger 5 to be defrosted, in the air-conditioning apparatus that employs the R410A refrigerant.

Figure 8D:
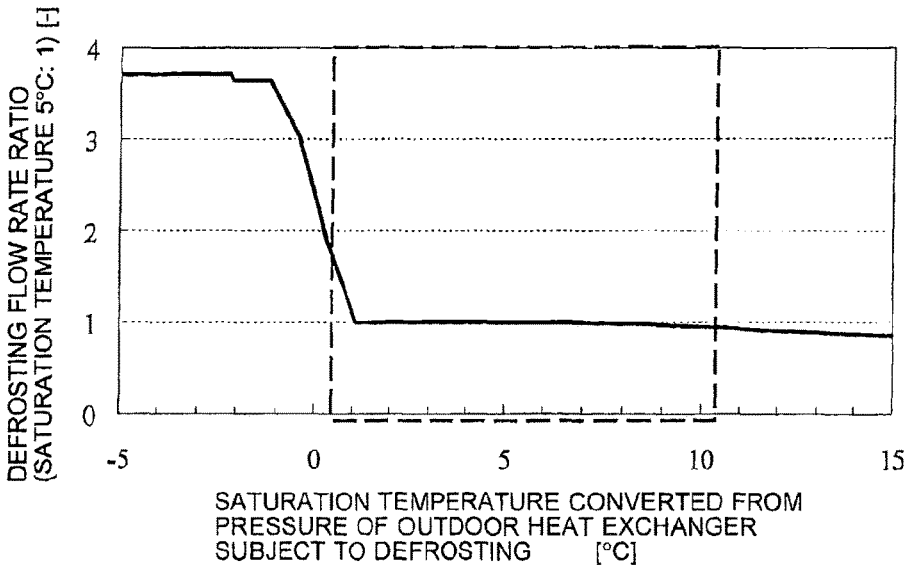
FIG. 8D is a graph showing ratios of defrosting flow rate under different pressures (converted to saturated liquid temperature) of the outdoor heat exchanger to be defrosted, of the air-conditioning apparatus 100 according to Embodiment 1 of the present invention.

FIG. 8D is a graph showing the flow rate based on fixed defrosting capacity, under different pressures (converted to saturated liquid temperature) of the outdoor heat exchanger 5 to be defrosted, in the air-conditioning apparatus that employs the R410A refrigerant.

Figure 8E:
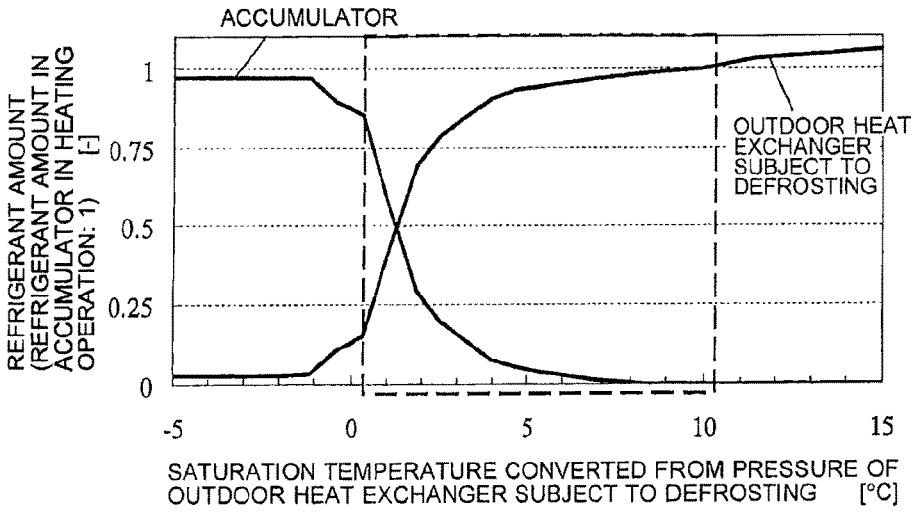
FIG. 8E is a graph showing refrigerant amounts in an accumulator 6 and the outdoor heat exchanger to be defrosted, under different pressures (converted to saturated liquid temperature) of the outdoor heat exchanger to be defrosted, of the air-conditioning apparatus 100 according to Embodiment 1 of the present invention.

FIG. 8E is a graph showing refrigerant amounts in the accumulator 6 and the outdoor heat exchanger 5 to be defrosted based on fixed defrosting capacity, under different pressures (converted to saturated liquid temperature) of the outdoor heat exchanger 5 to be defrosted, in the air-conditioning apparatus that employs the R410A refrigerant.

Figure 8F:
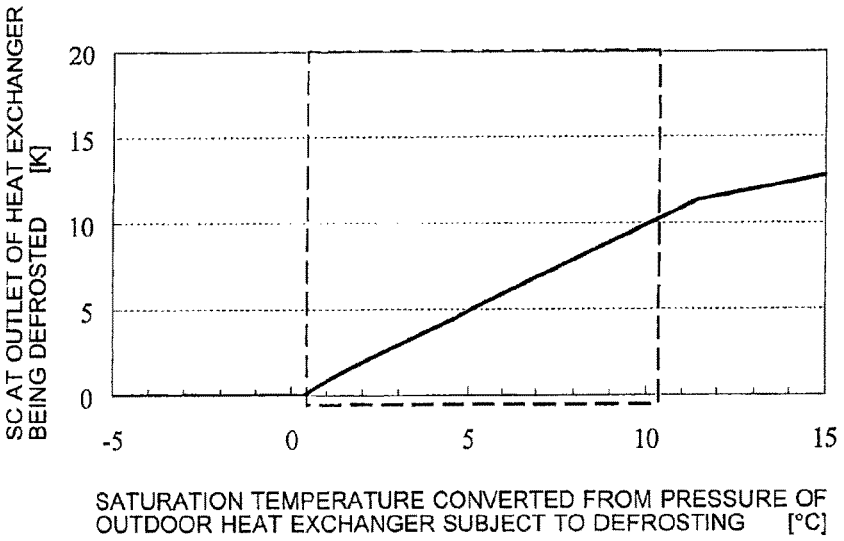
FIG. 8F is a graph showing degrees of subcooling SC at the outlet of the outdoor heat exchanger to be defrosted, under different pressures (converted to saturated liquid temperature) of the outdoor heat exchanger to be defrosted, of the air-conditioning apparatus 100 according to Embodiment 1 of the present invention.

FIG. 8F is a graph showing degrees of subcooling SC at the outlet of the outdoor heat exchanger 5 to be defrosted based on fixed defrosting capacity, under different pressures (converted to saturated liquid temperature) of the outdoor heat exchanger 5 to be defrosted, in the air-conditioning apparatus that employs the R410A refrigerant.

In view of FIG. 8B it may be understood that, in the outdoor heat exchanger 5 to be defrosted, the heating operation capacity increases when the saturated liquid temperature of the refrigerant is in the range between 0 degrees Celsius and 10 degrees Celsius, and that the heating operation capacity declines in other ranges.

First, description will be given about a reason that the heating operation capacity declines when the saturated liquid temperature is lower than 0 degrees Celsius.

To melt the frost the refrigerant temperature has to be higher than 0 degrees Celsius. As is apparent from FIG. 8A, when it is attempted to melt the frost with the saturated liquid temperature lower than 0 degrees Celsius, the position of the point (g) becomes higher than the saturated gas enthalpy. Accordingly, the condensation latent heat of the refrigerant is unable to be utilized, and the enthalpy difference between the inlet and outlet of the outdoor heat exchanger 5 to be defrosted is decreased (FIG. 8C).

Under such a condition, to achieve the same defrosting performance as the case where the saturated liquid temperature is in the optimum range of 0 degrees Celsius to 10 degrees Celsius, 3 to 4 times as much refrigerant has to be introduced into the outdoor heat exchanger to be defrosted (FIG. 8D), and therefore the amount of the refrigerant that can be supplied to the indoor units B and C performing the heating operation is accordingly reduced, which results in degraded heating operation capacity.

Setting the saturated liquid temperature to equal to or lower than 0 degrees Celsius leads to degraded heating operation capacity as in the low-pressure defrosting according to Parent Literature 1, and therefore the pressure of the outdoor heat exchanger 5 to be defrosted has to be higher than a level corresponding to a converted saturated liquid temperature of 0 degrees Celsius.

On the other hand, increasing the pressure of the outdoor heat exchanger 5 to be defrosted leads to an increase in degree of subcooling SC at the outlet of the outdoor heat exchanger 5 to be defrosted as shown in FIG. 8F. In other words, the amount of the liquid refrigerant increases, which results in increased refrigerant density.

Since an ordinary multi-air-conditioning apparatus for building requires a larger amount of refrigerant in the cooling operation than in the heating operation, a surplus refrigerant is stored in a reservoir such as the accumulator 6 in the heating operation. Accordingly, as shown in FIG. 8E, the larger the pressure, the larger amount of refrigerant is required by the outdoor heat exchanger 5 to be defrosted and hence the amount of the refrigerant stored in the accumulator 6 is reduced, and the accumulator becomes empty when the saturation temperature reaches approximately 10 degrees Celsius.

When the surplus liquid in the accumulator 6 is exhausted out, the refrigeration cycle suffers shortage of the refrigerant and the suction density of the compressor declines, and thus the heating operation capacity is degraded.

Here, excessively loading the refrigerant may raise the upper limit of the saturation temperature, however the liquid refrigerant may overflow from the accumulator in other operation modes, and the reliability of the air-conditioning apparatus may be degraded. Therefore, it is preferable to load an appropriate amount of refrigerant. In addition, the higher the saturation temperature is, the difference in temperature between the refrigerant in the heat exchanger and the frost is more likely to become uneven, and therefore in some regions the frost melts quickly, while in other regions the frost remains unmelted.

For the foregoing reasons, it is preferable to set the pressure of the outdoor heat exchanger 5 to be defrosted to a level corresponding to a converted saturation temperature between 0 degrees Celsius and 10 degrees Celsius.

In addition, from the viewpoint of making the most of the medium pressure defrosting that utilizes the latent heat while suppressing the displacement of the refrigerant to suppress the uneven melting of the frost, it is optimal to set the degree of subcooling SC at the outlet of the outdoor heat exchanger 5 to be defrosted to 0 K. Accordingly, when the accuracy of the temperature sensor and pressure sensor for detecting the subcooling is taken into account, it is preferable to set the pressure of the outdoor heat exchanger 5 to be defrosted to a level corresponding to a converted saturation temperature between 0 degrees Celsius and 6 degrees Celsius degree, so as to set the subcooling SC to a range between approximately 0 K and 5 K.

Hereunder, description will be given about an operation of the expansion device 10 and the second flow control devices 7-1 and 7-2 during the heating-defrosting operation.

In the heating-defrosting operation, the controller 30 controls the opening degree of the second flow control device 7-2 so as to set the pressure of the parallel heat exchanger 5-2 to be defrosted to a level corresponding to a converted saturation temperature between approximately 0 degrees Celsius and 10 degrees Celsius. The second flow control device 7-1 is fully opened to improve controllability by creating a large pressure difference between the inlet and the outlet of the second flow control device 7-2. In addition, the difference between the discharge pressure of the compressor 1 and the pressure of the parallel heat exchanger 5-2 to be defrosted does not remarkably fluctuate during the heating-defrosting operation, and therefore the opening degree of the expansion device 10 is fixed in accordance with the defrosting flow rate designed in advance.

The heat emitted from the refrigerant used for the defrosting is not only transferred to the frost stuck to the parallel heat exchanger 5-2, but a part of the heat may be emitted to outdoor air. Accordingly, the controller 30 may control the expansion device 10 and the second flow control device 7-2 so as to increase the defrosting flow rate as the outdoor temperature becomes drops. Such an arrangement allows a constant amount of heat to be applied to the frost, thereby allowing the defrosting to be performed in a constant period of time, irrespective of the outdoor temperature.

The controller 30 may also change, depending on the outdoor temperature, the threshold of the saturation temperature used for deciding whether frost has been formed, or the duration of the normal operation.

To be more detailed, the duration of the normal heating operation is shortened as the outdoor temperature drops, so that the same amount of frost is formed each time the heating-defrosting operation is started. Such an arrangement allows a constant amount of heat to be applied from the refrigerant to the frost during the heating-defrosting operation.

Consequently, the foregoing arrangement eliminates the need to control the defrosting flow rate with the expansion device 10, thereby allowing an inexpensive capillary tube that provides a constant flow resistance, in place of the expansion device 10.

Further, the controller 30 may set a threshold with respect to the outdoor temperature, to perform the heating-defrosting operation when the outdoor temperature is equal to or higher than the threshold (for example, outdoor temperature of −5 degrees Celsius or −10 degrees Celsius), and perform a heating-stopped defrosting operation in which the heating operation of the indoor unit is suspended and the entire surface of the plurality of parallel heat exchangers is defrosted, when the outdoor temperature is lower than the threshold.

When the outdoor temperature is lower than 0 degrees Celsius, for example −5 degrees Celsius or −10 degrees Celsius, the absolute humidity of the outdoor air is generally low and hence the frost formation rate is low, and therefore the normal operation is continued for a longer period of time before the amount of frost reaches a certain level. The ratio of the period of time in which the heating operation of the indoor unit is stopped is small, despite the entire surface of the plurality of parallel heat exchangers being defrosted with the heating operation of the indoor unit stopped. When the heating-defrosting operation is performed, selectively performing one of the heating-defrosting operation and the heating-stopped defrosting operation depending on the outdoor temperature enables the defrosting to be performed with higher efficiency, when the heat emission from the outdoor heat exchanger to be defrosted to the outdoor air is taken into account.

In the heating-stopped defrosting operation, the cooling-heating switching device 2 is set to OFF, the second flow control devices 7-1 and 7-2 are fully opened, the solenoid valves 8-2, 8-1 are set to ON, the second solenoid valves 9-1 and 9-2 are set to OFF, and the expansion device 10 is closed. Under such settings, the high-temperature/high-pressure gas refrigerant discharged from the compressor 1 passes through the cooling-heating switching device 2, the solenoid valve 8-1, and the solenoid valve 8-2 and flows into the parallel heat exchangers 5-1 and 5-2, to thereby melt the frost stuck to the parallel heat exchangers 5-1 and 5-2.

In the case where the parallel heat exchangers 5-1 and 5-2 are integrally formed and the outdoor air is transported by the outdoor fan 5*f* to the parallel heat exchanger subject to defrosting as in Embodiment 1, the output of the fan may be reduced as the outdoor temperature drops, in order to reduce the heat emission during the heating-defrosting operation.

[Control Process]

Figure 9:
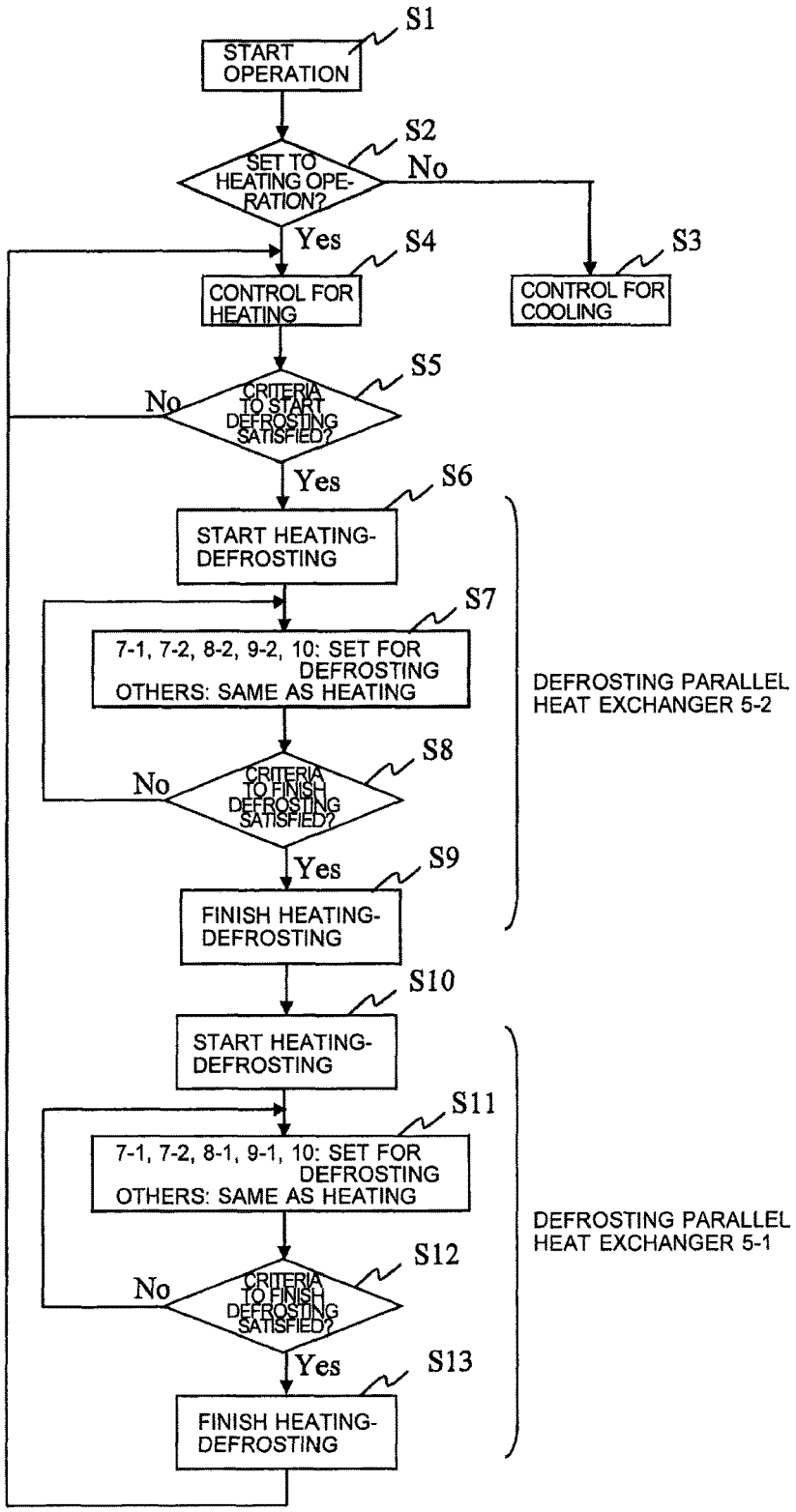
FIG. 9 is a flowchart showing a controlling operation of the air-conditioning apparatus 100 according to Embodiment 1 of the present invention.

FIG. 9 is a flowchart showing a controlling operation of the air-conditioning apparatus shown in FIG. 1.

When the operation is started (S1), it is determined whether the indoor units B and C are performing the cooling operation or the heating operation (S2), and the control is performed for the normal cooling operation (S3) or the normal heating operation (S4). In the heating operation, it is determined whether criteria for starting the defrosting, for example as expressed by the following equation (1), is satisfied (i.e., whether frost has been formed), taking into account the decline in heat transfer performance of the outdoor heat exchanger originating from the decline in heat transfer and air volume due to the frost formation (S5).

$$(\text{Saturation Temperature of Suction Pressure}) < (\text{Outdoor Temperature}) - x1 \quad (1)$$

It is preferable to set x1 to approximately 10 K to 20 K.

When the equation (1) is satisfied, the heating-defrosting operation is started to alternately defrost the parallel heat exchangers (S6). It is herein assumed that the parallel heat exchanger 5-2 in the lower block of the outdoor heat exchanger 5 in FIG. 2 is first defrosted, followed by the defrosting of the parallel heat exchanger 5-1 in the upper block. The defrosting order may be reversed. In the normal heating operation before entering the heating-defrosting operation, the ON/OFF setting of the valves is as shown in the column of "NORMAL HEATING OPERATION" in Table 1. The setting of the valves is then changed as shown in the column of "5-1: EVAPORATOR 5-2: DEFROSTING" under "HEATING-DEFROSTING OPERATION" in Table 1, to start the heating-defrosting operation (S6).

(a) Solenoid valve 8-2 OFF (b) Solenoid valve 9-2 ON (c) Open expansion device 10

(d) Fully open second flow control device 7-1

(e) Start controlling second flow control device 7-2

The heating-defrosting operation in which the parallel heat exchanger 5-2 subjected to the defrosting and the parallel heat exchanger 5-1 acts as evaporator is performed until the frost on the parallel heat exchanger 5-2 to be defrosted is melted and criteria for finishing the defrosting is satisfied (S7, S8). When the frost stuck to the parallel heat exchanger 5-2 starts to melt during the heating-defrosting operation, the refrigerant temperature in the first connection pipe 13-2 is increased. Accordingly, it is preferable, for example, to attach a temperature sensor to the first connection pipe 13-2 and determine that the criteria for finishing the defrosting is satisfied when the temperature detected by the sensor exceeds the threshold as defined by the equation (2) cited below.

$$(\text{Refrigerant Temperature of Injection Pipe}) > x2 \quad (2)$$

It is preferable to set x2 to approximately 5 to 10 degrees Celsius.

When the equation (2) is satisfied, the heating-defrosting operation for defrosting the parallel heat exchanger 5-2 is finished (S9).

(a) Solenoid valve 9-2 OFF (b) Solenoid valve 8-2 ON (c) Set second flow control devices 7-1, 7-2 to normal intermediate pressure Then the setting of the valves is changed as shown in the column of "5-1: DEFROSTING 5-2: EVAPORATOR" under "HEATING-DEFROSTING OPERATION" in Table 1, and the heating-defrosting operation for defrosting the parallel heat exchanger 5-1 is started. (S10) to (S13) are different from (S6) to (S9) only in the number of the valves, and hence the description will not be repeated.

Sequentially defrosting thus the parallel heat exchanger 5-2 in the upper block of the outdoor heat exchanger 5 and the parallel heat exchanger 5-1 in the lower block prevents formation of root ice. When the defrosting of both of the parallel heat exchanger 5-2 in the upper block and the parallel heat exchanger 5-1 in the lower block is finished and the heating-defrosting operation specified as (S6) to (S13) is finished, the normal heating operation (S4) is resumed.

When the heating-defrosting operation mode is entered, the outdoor heat exchanger 5 divided into a plurality of units is defrosted at least once. In the case where it is determined, when the outdoor heat exchanger 5 defrosted last resumes the heating operation, that the outdoor heat exchanger 5 defrosted first is again suffering frost formation and the heat transfer performance thereof is degraded, for example according to the detection of the temperature sensor provided in the refrigerant circuit, the second defrosting may be performed for the first defrosted outdoor heat exchanger 5, for a short period of time.

As described thus far, Embodiment 1 provides the following advantageous effects, in addition to the foregoing advantage of enabling the heating operation of the indoor unit to be continued while removing frost by the heating-defrosting operation.

For example, the refrigerant which has flowed out of the parallel heat exchanger 5-2 to be defrosted is introduced into the main circuit at a position upstream of the parallel heat exchanger 5-1, which is not the object of the defrosting. Such an arrangement improves the defrosting efficiency.

In addition, a part of the high-temperature/high-pressure gas refrigerant divided from the discharge pipe 1*a* is depressurized to a level corresponding to a converted saturation temperature of approximately 0 degrees Celsius to 10 degrees Celsius, which is higher than the temperature of the frost, before flowing into the outdoor heat exchanger 5 to be defrosted. Therefore, the condensation latent heat of the refrigerant can be utilized.

Thus, since the saturation temperature is approximately 0 degrees Celsius to 10 degrees Celsius, which makes only a small difference from the temperature of the frost, the degree of subcooling at the outlet of the outdoor heat exchanger 5 to be defrosted is as low as approximately 5 K. Therefore, the amount of the refrigerant used for the outdoor heat exchanger 5 to be defrosted can be reduced, and shortage of the refrigerant in the refrigeration cycle as a whole can be avoided.

In addition, a larger part of the refrigerant in the heat transfer tube of the outdoor heat exchanger 5 to be defrosted assumes the gas-liquid two-phase state, and therefore the temperature difference from the frost temperature becomes constant over a larger region, which allows the progress of the defrosting to be uniform over the entirety of the heat exchanger.

Further, the refrigerant discharged from the outdoor heat exchanger 5 to be defrosted is introduced into the outdoor heat exchanger 5 acting as evaporator. Therefore, the evaporation performance of the refrigeration cycle can be maintained, so as to suppress a decline in suction pressure.

Further, reverse flow of the liquid to the compressor 1 can be prevented.

Still further, controlling the flow rate of the expansion device 10 enables the defrosting capacity to be variably adjusted.

Therefore, even when the temperature of the outdoor air is low, the duration in time required for the defrosting can be maintained constant by increasing the flow rate of the expansion device 10.

Embodiment 2

Figure 10:
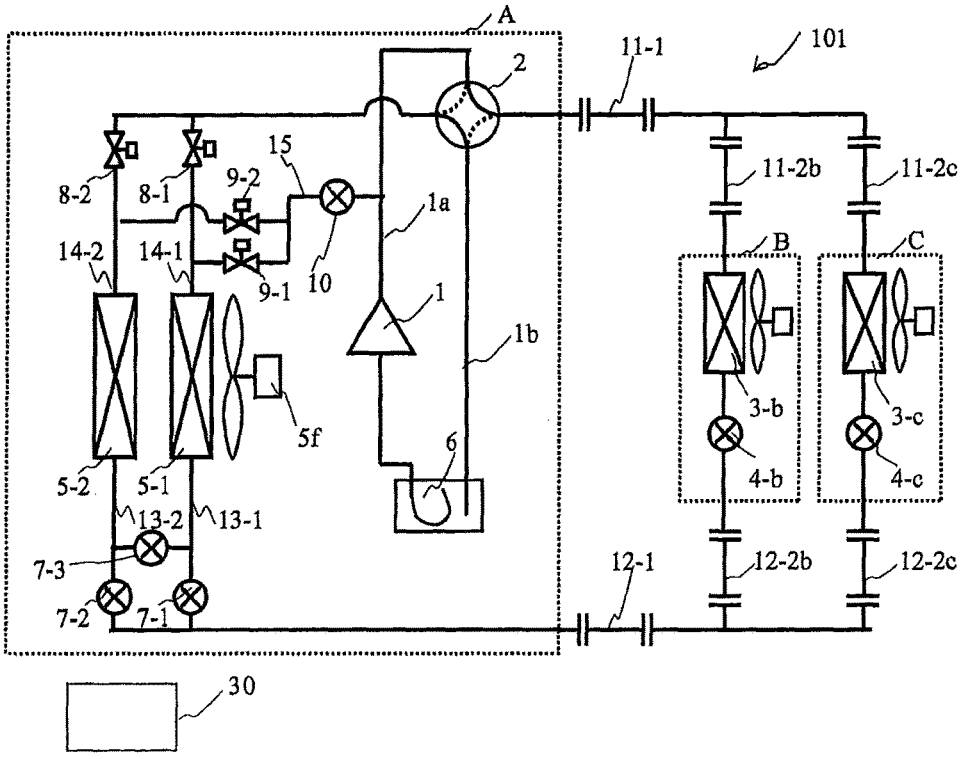
FIG. 10 is a circuit diagram showing a refrigerant circuit configuration of an air-conditioning apparatus 101 according to Embodiment 2 of the present invention.

FIG. 10 is a circuit diagram showing a refrigerant circuit configuration of an air-conditioning apparatus 101 according to Embodiment 2 of the present invention.

Hereunder, the air-conditioning apparatus 101 will be described focusing on differences from Embodiment 1.

The air-conditioning apparatus 101 according to Embodiment 2 includes a third flow control device 7-3, in addition to the configuration of the air-conditioning apparatus 100 according to Embodiment 1.

The third flow control device 7-3 is a valve with variable opening degree provided in a pipe that circumvents the first connection pipe 13-1 and the first connection pipe 13-2, and constituted of, for example, an electronically controlled expansion valve.

The third flow control device 7-3 of Embodiment 2 corresponds to the connection switching device and the second expansion device in the present invention.

Figure 11:
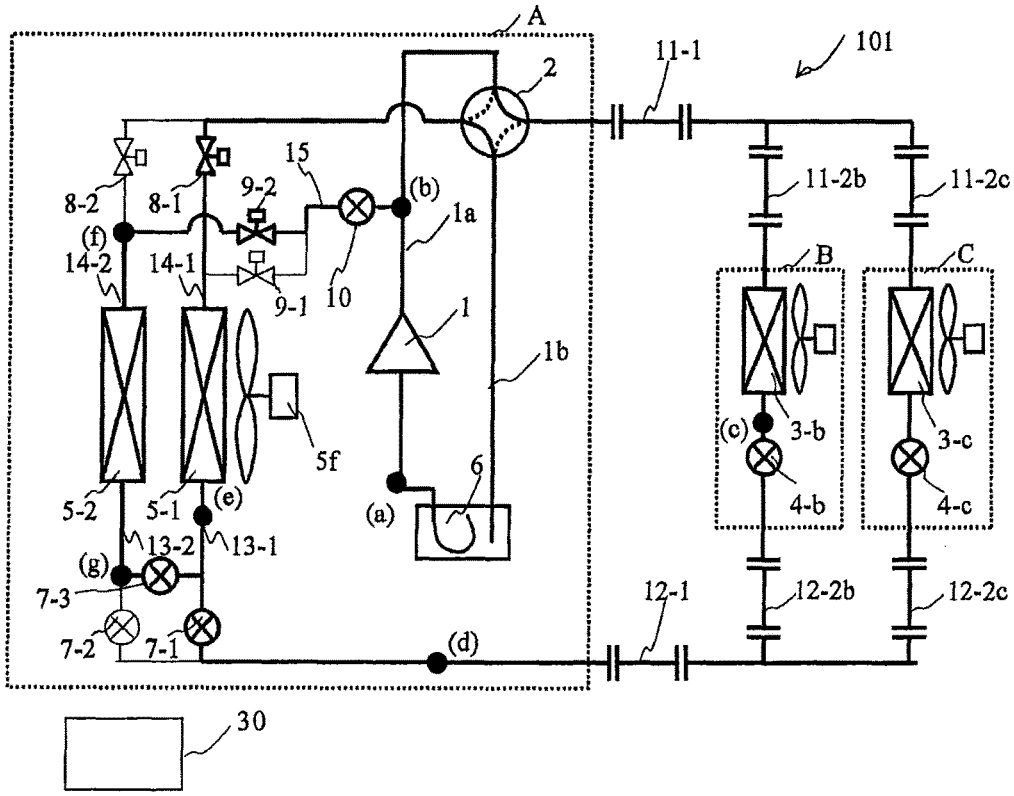
FIG. 11 is a circuit diagram showing a refrigerant flow in the heating-defrosting operation of the air-conditioning apparatus 101 according to Embodiment 2 of the present invention.

FIG. 11 is a circuit diagram showing the refrigerant flow in the heating-defrosting operation of the air-conditioning apparatus 101 according to Embodiment 2 of the present invention. In FIG. 11, bold lines indicate the refrigerant flow in the heating-defrosting operation, and fine lines indicate the sections where the refrigerant does not flow.

Figure 12:
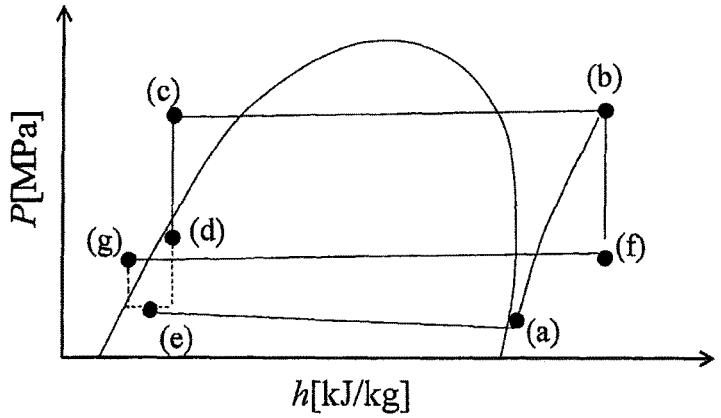
FIG. 12 is a P-h line graph of the heating-defrosting operation of the air-conditioning apparatus 101 according to Embodiment 2 of the present invention.

FIG. 12 is a P-h line graph of the heating-defrosting operation of the air-conditioning apparatus 101 according to Embodiment 2 of the present invention. Points (a) to (g) in FIG. 12 indicate the status of the refrigerant at the positions of the same reference code in FIG. 11.

In the heating-defrosting operation according to Embodiment 2, the position where the refrigerant of the main stream and the refrigerant that has passed through the outdoor heat exchanger 5 to be defrosted join each other is different from the air-conditioning apparatus 100 according to Embodiment 1.

The controller 30 closes the solenoid valve 8-2 associated with the parallel heat exchanger 5-2 to be defrosted, upon detecting that the defrosting has to be performed to remove frost, while performing the normal heating operation. The controller 30 then opens the second solenoid valve 9-2, and sets the expansion device 10 to a predetermined opening degree. At this point, the second flow control device 7-2 associated with the parallel heat exchanger 5-2 to be defrosted is fully closed. In contrast, the third flow control device 7-3 is fully opened.

With such settings, the medium-pressure defrosting circuit, in which the compressor 1, the expansion device 10, the solenoid valve 9-2, the parallel heat exchanger 5-2, and the third flow control device 7-3 are sequentially connected, is opened and the heating-defrosting operation can be started.

When the heating-defrosting operation is started, a part of the high-temperature/high-pressure gas refrigerant discharged from the compressor 1 flows into the first defrost pipe 15, and is depressurized to a medium pressure in the expansion device 10. The transition of the refrigerant in this process may be expressed by the points (b) to (f) in FIG. 12.

The refrigerant depressurized to the medium pressure (point (f)) passes through the solenoid valve 9-2 and flows into the parallel heat exchanger 5-2. The refrigerant which has entered the parallel heat exchanger 5-2 exchanges heat with the frost stuck to the parallel heat exchanger 5-2, thus being cooled. The transition of the refrigerant in this process may be expressed by the points (f) and (g) in FIG. 12. Here, the refrigerant used for the defrosting is set to a saturation temperature of approximately 0 degrees Celsius to 10 degrees Celsius, slightly higher than the frost temperature (0 degrees Celsius).

The refrigerant that has been used for the defrosting passes through the third flow control device 7-3, and joins the main stream through the first connection pipe 13-1 disposed between the second flow control device 7-1 and the parallel heat exchanger 5-1 (point (e)). The refrigerant which has joined the main stream flows into the parallel heat exchanger 5-1 acting as evaporator, thus to be evaporated.

As described above, in Embodiment 2 the refrigerant that has passed through the outdoor heat exchanger 5 to be defrosted is introduced into the low-pressure section (corresponding to suction pressure of compressor 1), so that the intermediate pressure (point (d)) and the medium pressure (point (f)) can be separately controlled.

In addition, the intermediate pressure may become higher than the medium pressure, and therefore small-sized valves having a low Cv value may be employed as the second flow control devices 7-1 and 7-2.

In the configuration of Embodiment 1, in contrast, the intermediate pressure (pressure of second connection pipe 12-1) has to be made lower than the medium pressure (pressure of refrigerant introduced into heat exchanger to be defrosted), in order to allow the refrigerant that has passed through the outdoor heat exchanger 5 to be defrosted to join the main stream.

Embodiment 3

Figure 13:
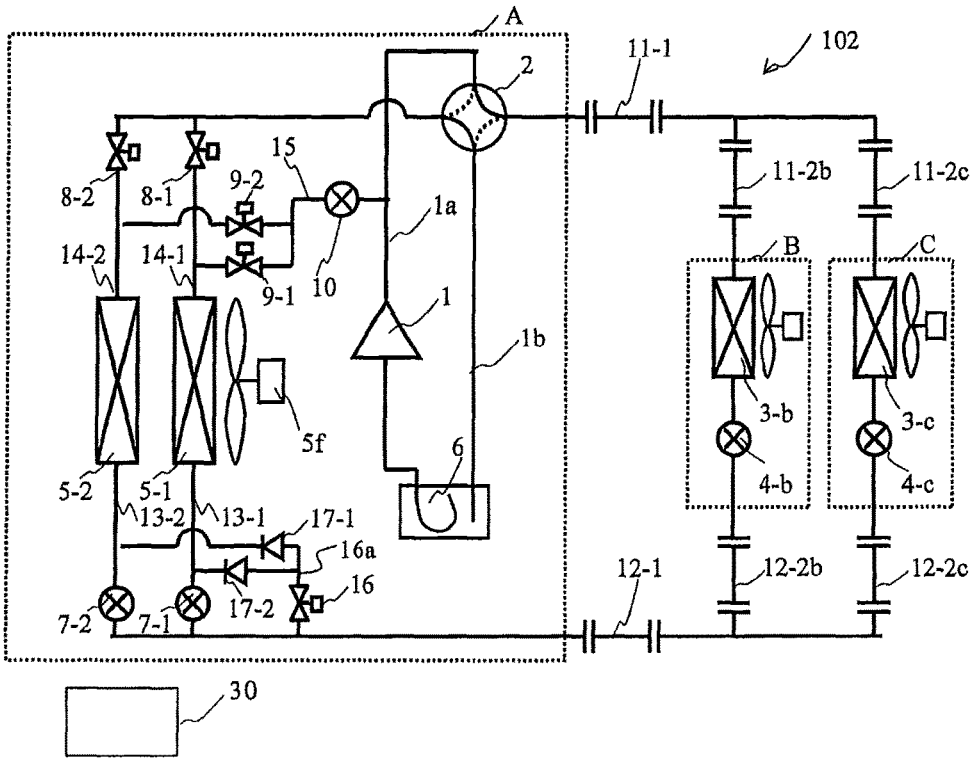
FIG. 13 is a circuit diagram showing a refrigerant circuit configuration of an air-conditioning apparatus 102 according to Embodiment 3 of the present invention.

FIG. 13 is a circuit diagram showing a refrigerant circuit configuration of an air-conditioning apparatus 102 according to Embodiment 3 of the present invention.

Hereunder, the air-conditioning apparatus 102 will be described focusing on differences from Embodiment 1.

The air-conditioning apparatus 102 according to Embodiment 2 includes, in addition to the configuration of the air-conditioning apparatus 100 of Embodiment 1, a pipe disposed in the intermediate pressure section of the main circuit (between second connection pipe 12-1 and second flow control devices 7-1 and 7-2), a bypass pipe 16*a* connecting between the first connection pipes 13-1 and 13-2, a solenoid valve 16 provided in the bypass pipe 16*a*, and check valves 17-1 and 17-2 that only allow the refrigerant flow from the pipe in the intermediate pressure section of the main circuit to the parallel heat exchangers 5-1 and 5-2.

In Embodiment 3 also, the second flow control devices 7-1 and 7-2 correspond to the connection switching device and the second expansion device in the present invention.

In the heating-defrosting operation according to Embodiment 3 also, the medium-pressure defrosting circuit, in which the compressor 1, the expansion device 10, the solenoid valve 9-2, the parallel heat exchanger 5-2, the second flow control device 7-2, and the second flow control device 7-1 are sequentially connected, is opened and the heating-defrosting operation can be started as in Embodiment 1.

In the heating-defrosting operation of Embodiment 3, further the solenoid valve 16 is opened, so as to allow the refrigerant of the intermediate pressure (pressure of second connection pipe 12-1) to circumvent the second flow control device 7-2 and the second flow control device 7-1, to the upstream side and the downstream side thereof, respectively.

As described above, in Embodiment 3 the refrigerant of the intermediate pressure is introduced into the first connection pipes 13-1 and 13-2, and therefore the intermediate pressure can be reduced despite employing small-sized valves having a low Cv value as the second flow control devices 7-1 and 7-2.

Therefore, the medium pressure control of the outdoor heat exchanger 5 to be defrosted can be stably performed, by utilizing the second flow control devices 7-1 and 7-2.

Embodiment 4

Figure 14:
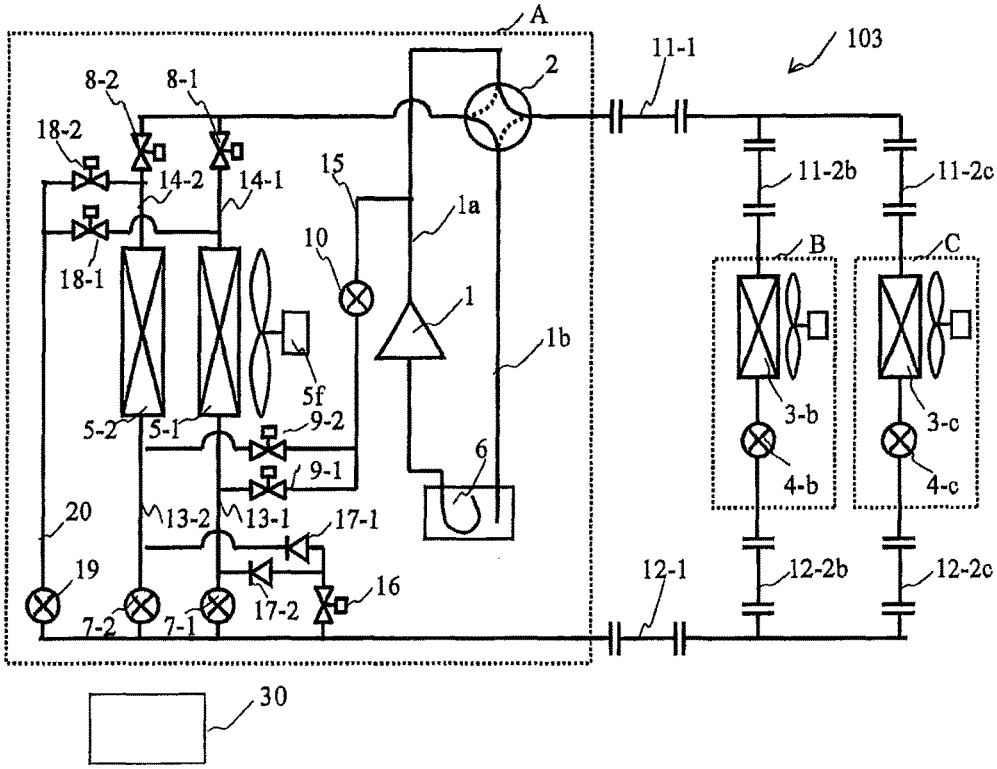
FIG. 14 is a circuit diagram showing a refrigerant circuit configuration of an air-conditioning apparatus 103 according to Embodiment 4 of the present invention.

FIG. 14 is a circuit diagram showing a refrigerant circuit configuration of an air-conditioning apparatus 103 according to Embodiment 4 of the present invention.

Hereunder, the air-conditioning apparatus 103 will be described focusing on differences from Embodiment 1.

In the air-conditioning apparatus 103 according to Embodiment 4, the first defrost pipe 15 is connected to the first connection pipes 13-1 and 13-2, unlike the configuration of the air-conditioning apparatus 102 of Embodiment 3.

In addition, the air-conditioning apparatus 103 includes, in addition to the configuration of the air-conditioning apparatus 102 of Embodiment 3, a second defrost pipe 20 connecting between the pipe disposed in the intermediate pressure section of the main circuit (between second connection pipe 12-1 and second flow control devices 7-1 and 7-2) and the second connection pipes 14-1 and 14-2.

The second defrost pipe 20 includes a fourth flow control device 19 which is a valve with variable opening degree and constituted of, for example, an electronically controlled expansion valve. The second defrost pipe 20 also includes solenoid valves 18-1 and 18-2 respectively associated with the second connection pipes 14-1 and 14-2.

The fourth flow control device 19 according to Embodiment 4 corresponds to the connection switching device and the second expansion device in the present invention.

The controller 30 closes the solenoid valve 8-2 associated with the parallel heat exchanger 5-2 to be defrosted and fully closes the second flow control device 7-2, upon detecting that the defrosting has to be performed to remove frost, while performing the normal heating operation. The controller 30 then opens the second solenoid valve 9-2, and sets the expansion device 10 to a predetermined opening degree. Further, the controller 30 opens the solenoid valve 18 associated with the parallel heat exchanger 5-2 to be defrosted and increases the opening degree of the third flow control device.

With such settings, the medium-pressure defrosting circuit, in which the compressor 1, the expansion device 10, the solenoid valve 9-2, the parallel heat exchanger 5-2, the solenoid valve 18-2, the fourth flow control device 19, and the second flow control device 7-1 are sequentially connected, is opened and the heating-defrosting operation can be started.

During the heating-defrosting operation, the controller 30 controls the opening degree of the fourth flow control device 19 so as to set the pressure (medium pressure) of the parallel heat exchanger 5-2 to be defrosted to a level corresponding to a converted saturation temperature between approximately 0 degrees Celsius and 10 degrees Celsius.

Further, as in Embodiment 3, the refrigerant of the intermediate pressure can be made to circumvent the second flow control device 7-2 and the second flow control device 7-1, to the upstream side and the downstream side thereof, respectively, by opening the solenoid valve 16. Here, although the configuration of Embodiment 4 includes the intermediate pressure bypass pipe, the solenoid valve 16, and the check valves 17-1 and 17-2 referred to in Embodiment 3, the present invention is not limited to such a configuration. The constituents cited above may be omitted.

Figure 15:
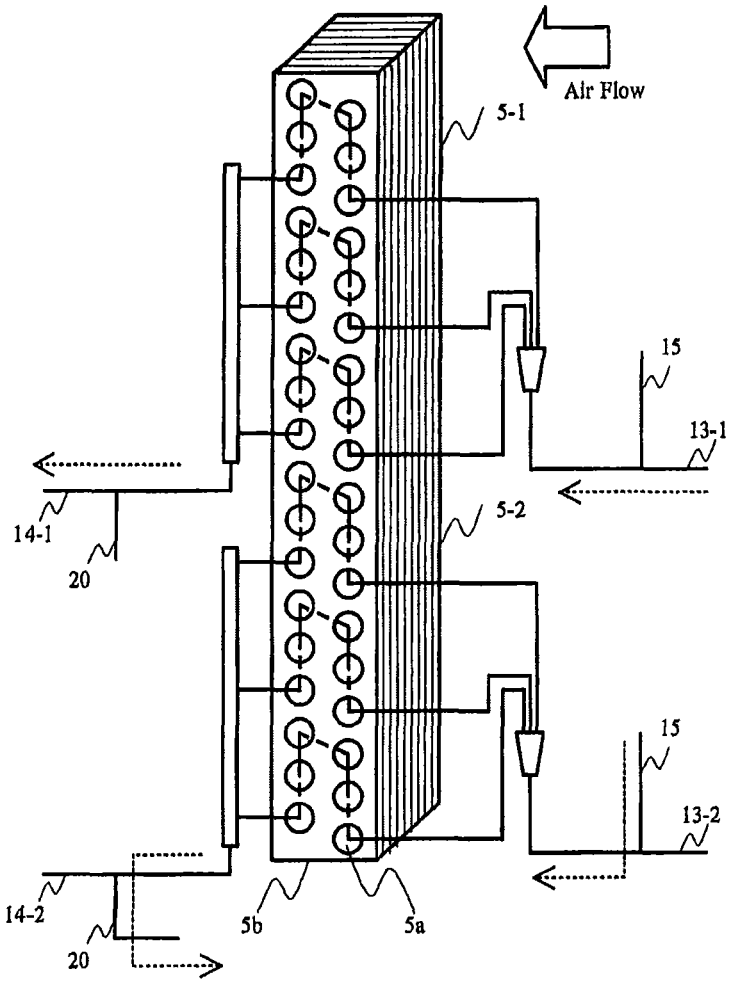
FIG. 15 is a schematic perspective view showing a refrigerant flow in the outdoor heat exchanger in the heating-defrosting operation.

FIG. 15 is a schematic perspective view showing a refrigerant flow in the outdoor heat exchanger in the heating-defrosting operation. In FIG. 15, the flow direction of the refrigerant is indicated by dotted arrows.

In the heating-defrosting operation according to Embodiment 4, a part of the high-temperature/high-pressure refrigerant discharged from the compressor 1 flows into the first connection pipe 13-2 through the first defrost pipe 15, and is introduced into the parallel heat exchanger 5-2 to be defrosted. The refrigerant used for the defrosting then passes through the second defrost pipe 20 and joins the main circuit through the first connection pipe 13-1.

As shown in FIG. 15, the first connection pipes 13-1 and 13-2 are connected to the heat transfer tubes 5*a* on the upstream side along the direction of airflow through the parallel heat exchanger 5-1 and 5-2. The heat transfer tubes 5*a* are aligned in a plurality of rows in the parallel heat exchangers 5-1 and 5-2 in the direction of the airflow, and air sequentially flows toward the downstream rows.

Accordingly, the refrigerant supplied to the parallel heat exchanger 5-2 to be defrosted flows from the heat transfer tube 5*a* on the upstream side in the airflow direction toward the downstream pipes, such that the refrigerant flow direction and the airflow direction agree with each other (parallel flow).

As described above, the configuration according to Embodiment 4 allows the refrigerant flow direction and the airflow direction to agree with each other, in the outdoor heat exchanger 5 to be defrosted. In addition, realizing the parallel flow of the refrigerant allows the heat emitted to the air in the defrosting process to be utilized for removing the frost stuck to the fins 5*b* on the downstream side, thereby improving the defrosting efficiency.

Embodiment 5

Figure 16:
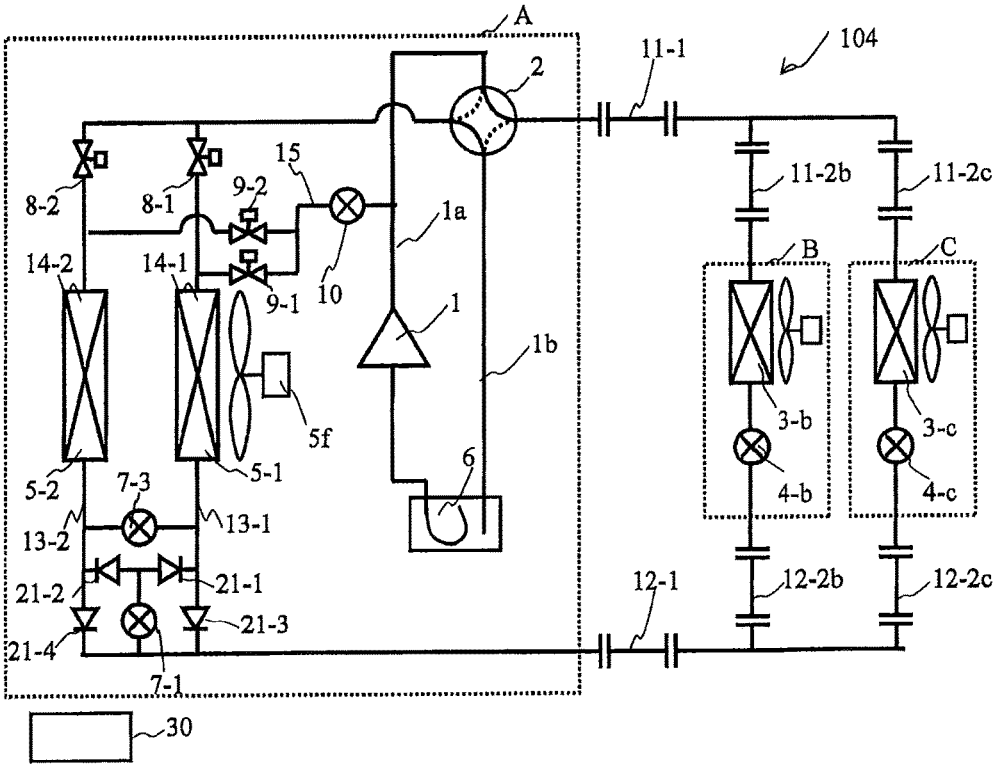
FIG. 16 is a circuit diagram showing a refrigerant circuit configuration of an air-conditioning apparatus 104 according to Embodiment 5 of the present invention.

FIG. 16 is a circuit diagram showing a refrigerant circuit configuration of an air-conditioning apparatus 104 according to Embodiment 5 of the present invention.

Hereunder, the air-conditioning apparatus 104 will be described focusing on differences from Embodiment 2.

The air-conditioning apparatus 104 according to Embodiment 5 is without the second flow control device 7-2 but includes check valves 21-1 and 21-2 that allow the refrigerant to flow only in the direction from the second flow control device 7-1 to the first connection pipes 13-1 and 13-2, instead of the configuration of the air-conditioning apparatus 101 according to Embodiment 2. In addition, the air-conditioning apparatus 104 includes check valves 21-3 and 21-4 that allow the refrigerant to flow only in the direction from the first connection pipes 13-1 and 13-2 to the second connection pipe 12-1.

With such a configuration, the high-pressure liquid refrigerant flows from the first connection pipes 13-1 and 13-2 to the second connection pipe 12-1 through the check valves 21-3 and 21-4, in the cooling operation.

In the heating operation, the intermediate pressure refrigerant flows from the second connection pipe 12-1 into the first connection pipes 13-1 and 13-2, through the second flow control device 7-1 and the check valves 21-1 and 21-2.

In the heating-defrosting operation, the refrigerant flows through the third flow control device 7-3, when flowing from the outdoor heat exchanger 5 to be defrosted to the outdoor heat exchanger 5 acting as evaporator. To flow from the main stream (intermediate pressure) to the outdoor heat exchanger 5 acting as evaporator, the refrigerant flows through the second flow control device 7-1 and one of the check valves 21-1 and 21-2.

With the mentioned configuration, the intermediate pressure can be made higher than the pressure of the refrigerant in the outdoor heat exchanger 5 to be defrosted with a fewer number of flow control devices that control the flow rate of the refrigerant, and the controlling operation can be further stabilized.

Embodiment 6

Figure 17:
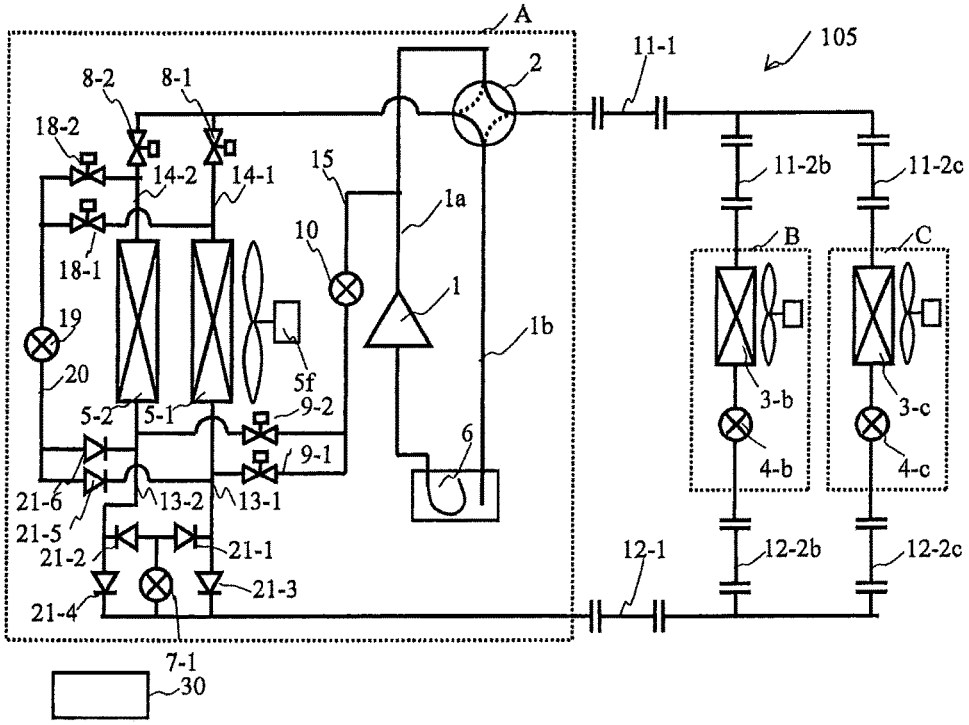
FIG. 17 is a circuit diagram showing a refrigerant circuit configuration of an air-conditioning apparatus 105 according to Embodiment 6 of the present invention.

FIG. 17 is a circuit diagram showing a refrigerant circuit configuration of an air-conditioning apparatus 105 according to Embodiment 6 of the present invention.

Hereunder, the air-conditioning apparatus 105 will be described focusing on differences from Embodiment 4 and Embodiment 5.

The air-conditioning apparatus 105 according to Embodiment 6 is different from the air-conditioning apparatus 103 of Embodiment 4 in including the same circuit as that of the air-conditioning apparatus 104 of Embodiment 5, modified from the air-conditioning apparatus 101 of Embodiment 2. In addition, the air-conditioning apparatus 105 includes check valves 21-5 and 21-6 that allow, in the heating-defrosting operation, the refrigerant flowing out of the second defrost pipe 20 and the fourth flow control device 19 to flow into the outdoor heat exchanger 5 acting as evaporator.

The mentioned configuration also allows, as in Embodiment 5, the intermediate pressure to be higher than the pressure of the refrigerant in the outdoor heat exchanger 5 to be defrosted with a fewer number of flow control devices that control the flow rate of the refrigerant, thereby further stabilizing the controlling operation.

Although Embodiments 1 to 6 refer to the case where the outdoor heat exchanger 5 is divided into two parallel heat exchangers 5-1 and 5-2, the present invention is not limited to such a configuration. In a configuration that includes three or more parallel heat exchangers also, a part of the parallel heat exchangers can be designated as object of the defrosting so as to continue the heating operation with the remaining parallel heat exchangers, by applying the foregoing inventive concept.

Further, although Embodiments 1 to 6 refer to the case where the outdoor heat exchanger 5 is divided, the present invention is not limited to such a configuration. In a configuration that includes a plurality of independent outdoor heat exchangers connected in parallel to each other also, a part of the outdoor heat exchangers 5 can be designated as object of the defrosting so as to continue the heating operation with the remaining outdoor heat exchangers 5, by applying the foregoing inventive concept.

REFERENCE SIGNS LIST

1: compressor, 1*a*: discharge pipe, 1*b*: suction pipe, 2: cooling-heating switching device (four-way valve), 2-1, 2-2, 2-3: four-way valve, 3-*b*: indoor heat exchanger, 3-*c*: indoor heat exchanger, 4-*b*: first flow control device, 4-*c*: first flow control device, 5-1: parallel heat exchanger, 5-2: parallel heat exchanger, 5: outdoor heat exchanger, 5*a*: heat transfer tube, 5*b*: fin, 5*f*: outdoor fan, 6: accumulator, 7-1: second flow control device, 7-2: second flow control device, 7-3: third flow control device, 8-1: solenoid valve, 8-2: solenoid valve, 8-3: solenoid valve, 9-1: solenoid valve, 9-2: solenoid valve, 10: expansion device, 11-1: first extension pipe, 11-2*b*: first extension pipe, 11-2*c*: first extension pipe, 12-1: second extension pipe, 12-2*b*: second extension pipe, 12-2*c*: second extension pipe, 13-1: first connection pipe, 13-2: first connection pipe, 14-1: second connection pipe, 14-2: second connection pipe, 15: first defrost pipe, 16: solenoid valve, 16*a*: bypass pipe, 17-1: check valve, 17-2: check valve, 18-1: solenoid valve, 18-2: solenoid valve, 19: fourth flow control device, 20: second defrost pipe, 21-1, 21-2, 21-3, 21-4, 21-5, 21-6: check valve, 30: controller, 31-1, 31-2, 31-3: check valve, 100, 101, 102, 103, 104, 105: air-conditioning apparatus, A: outdoor unit, B, C: indoor unit

The invention claimed is:

1. An air-conditioning apparatus comprising:

a main circuit formed by sequentially connecting, via a pipe, a compressor, an indoor heat exchanger, a first flow control device, and a plurality of parallel heat exchangers so as to allow refrigerant to circulate;

a first defrost pipe configured to branch from a flow path of the refrigerant from the compressor, allow a part of the refrigerant discharged from the compressor to pass therethrough, allow any of the plurality of parallel heat exchangers to be selected as a parallel heat exchanger subject to defrosting, and allow the part of the refrigerant to flow into the parallel heat exchanger selected as the parallel heat exchanger subject to defrosting;

a first expansion device provided in the first defrost pipe and configured to depressurize the refrigerant discharged from the compressor; and a connection switching device that allows the refrigerant flowing out of the parallel heat exchanger subject to defrosting to flow into the main circuit at a position upstream of one or more of the parallel heat exchangers other than the parallel heat exchanger subject to defrosting.

2. The air-conditioning apparatus of claim 1, wherein, in a defrosting operation including allowing the part of the refrigerant discharged from the compressor to flow into the parallel heat exchanger subject to defrosting is performed, and at least one of the plurality of parallel heat exchangers other than the parallel heat exchanger subject to defrosting acts as evaporator so as to perform a heating operation.

3. The air-conditioning apparatus of claim 1, wherein the connection switching device includes a second expansion device provided in each of pipes respectively connected to the plurality of parallel heat exchangers on a side of the first flow control device.

4. The air-conditioning apparatus of claim 3, further comprising:

a second bypass pipe connecting between a pipe disposed between the second expansion device and first flow control device and a pipe disposed between the second expansion device and the parallel heat exchanger; and a check valve provided in the second bypass pipe and configured to allow the refrigerant to flow from the pipe disposed between the second expansion device and the first flow control device to the pipe disposed between the second expansion device and the parallel heat exchanger.

5. The air-conditioning apparatus of claim 3, wherein a pressure of the refrigerant flowing out of the parallel heat exchanger subject to defrosting is controlled by the second expansion device.

6. The air-conditioning apparatus of claim 5, wherein an opening degree of the second expansion device is controlled so as to set the pressure of the refrigerant flowing out of the parallel heat exchanger subject to defrosting to a level corresponding to a saturation temperature between 0 degrees Celsius and 10 degrees Celsius converted from the pressure.

7. The air-conditioning apparatus of claim 1, wherein the connection switching device includes a second expansion device provided in a pipe connecting between the pipes respectively connected to the plurality of parallel heat exchangers on the side of the first flow control device, and the refrigerant flowing out of the parallel heat exchanger subject to defrosting is introduced into an inlet pipe of one of the parallel heat exchangers other than the parallel heat exchanger subject to defrosting.

8. The air-conditioning apparatus of claim 1, further comprising a second defrost pipe having an end connected to each of the pipes respectively connected to the plurality of parallel heat exchangers on a side of the compressor and an other end connected to a pipe disposed between the plurality of parallel heat exchangers and the first flow control device, wherein the first defrost pipe has an end connected to a discharge pipe of the compressor and an other end connected to each of the pipes respectively connected to the plurality of parallel heat exchangers on the side of the first flow control device, the parallel heat exchanger includes:

a plurality of heat transfer tubes in which the refrigerant flows, the heat transfer tubes being aligned in a plurality of rows in a column direction perpendicular to an air passage direction and in a row direction parallel to the air passage direction; and a plurality of fins spaced from each other so as to allow air to pass in the air passage direction, the first defrost pipe is connected to a pipe connected to the heat transfer tube in a windward row in the air passage direction, and the second defrost pipe is connected to a pipe connected to the heat transfer tube in a leeward row in the air passage direction.

9. The air-conditioning apparatus of claim 1, wherein a flow rate of the first expansion device is controlled depending on an outdoor temperature.

10. The air-conditioning apparatus of claim 1, wherein a duration in time of a normal heating operation in which all of the plurality of parallel heat exchangers act as evaporator is determined depending on the outdoor temperature.

11. The air-conditioning apparatus of claim 1, wherein a heating-defrosting operation including allowing the part of the refrigerant discharged from the compressor to flow into the parallel heat exchanger subject to defrosting among the plurality of parallel heat exchangers, and causing at least one of the parallel heat exchangers other than the parallel heat exchanger subject to defrosting to act as evaporator so as to perform the heating operation, is performed when the outdoor temperature is equal to or higher than a threshold, and a heating-stopped defrosting operation including allowing the refrigerant discharged from the compressor to flow into all of the plurality of parallel heat exchangers is performed, when the outdoor temperature is lower than the threshold.

12. The air-conditioning apparatus of claim 1, further comprising a fan that sends air to the plurality of parallel heat exchangers, wherein an output of the fan is changed depending on the outdoor temperature, in the defrosting operation including allowing the part of the refrigerant discharged from the compressor to flow into the parallel heat exchanger subject to defrosting.

13. The air-conditioning apparatus of claim 1, wherein each of the plurality of parallel heat exchangers is subjected to defrosting at least once, in the defrosting operation including allowing the part of the refrigerant discharged from the compressor to flow into the parallel heat exchanger subject to defrosting, among the plurality of parallel heat exchangers.

* * * * *